US010279964B2

(12) United States Patent
Bloom

(10) Patent No.: US 10,279,964 B2
(45) Date of Patent: May 7, 2019

(54) HINGE WITH SNAPPABLY INSERTABLE PIN FOR USE WITH A LID AND CONTAINER

(71) Applicant: Incredible Solutions Inc., Warren, OH (US)

(72) Inventor: Ted E. Bloom, Warren, OH (US)

(73) Assignee: INCREDIBLE SOLUTIONS INC., Warren, OH (US)

( * ) Notice: Subject to any disclaimer, the term of this patent is extended or adjusted under 35 U.S.C. 154(b) by 0 days.

(21) Appl. No.: 15/705,207

(22) Filed: Sep. 14, 2017

(65) Prior Publication Data

US 2018/0072469 A1 Mar. 15, 2018

Related U.S. Application Data

(60) Provisional application No. 62/395,300, filed on Sep. 15, 2016.

(51) Int. Cl.
*B65D 43/16* (2006.01)

(52) U.S. Cl.
CPC ..... *B65D 43/165* (2013.01)

(58) Field of Classification Search
CPC .. B65D 43/165; B65D 43/164; B65D 43/167; B65D 43/166; B65D 43/163; B65D 43/16; B65D 51/18; B65F 1/1646; B65F 1/1615; B65F 1/16; B65F 1/1607
USPC ..... 220/848, 845, 844, 843, 836, 810, 263, 220/262, 495.11, 495.08, 495.06, 908.1,
(Continued)

(56) References Cited

U.S. PATENT DOCUMENTS 1,488,375 A * 3/1924 Bowers ..... B65D 43/164 16/355
2,766,901 A * 10/1956 Sunko ..... E05D 5/10 16/262

(Continued)

OTHER PUBLICATIONS

"IRIS Airtight Pet Food Storage Container, Clear/Black" published online at [https://www.chewy.com/iris-airtight-pet-food-storage/dp/133313?utm_source=google-product&utm_medium=cpc&utm_campaign=hg&utm_content=IRIS&utm_term=&gclid=CjwKCAjw6djYBRB8EiwAoAF6oRN2cMqUxbGnzB-qrF_d8YdJk_sK1P_bfFWygeH0qaioh71NwUbSGxoC7JcQAvD_BwE] retrieved on Jun. 5, 2018, 6 pages.

(Continued)

*Primary Examiner* — Robert J Hicks
(74) *Attorney, Agent, or Firm* — Amin, Turocy & Watson, LLP

(57) ABSTRACT

A container, comprising a hinge component that can secure a lid component of the container with a container component of the container, is presented. The hinge component can comprise a pin component and base component. The pin component can be associated with the lid component and the base component can be associated with a wall of the container component, or vice versa. The pin component can comprise one or more protruding portions extending from one or more smaller portions that can be associated with respective ends of the protruding portions along the pin component. The pin component can be removably attached to the base component by inserting one or more protruding portions of the pin component into one or more respective base slot components of the base component, the base slot component(s) retaining the protruding portion(s) therein to attach the lid component to the container component.

20 Claims, 19 Drawing Sheets

(58) Field of Classification Search
USPC ..... 220/908, 254.6, 254.3, 254.1, 259.2, 220/259.1, 256.1
See application file for complete search history.

(56) References Cited

U.S. PATENT DOCUMENTS

| | | | | |
|---|---|---|---|---|
| 4,863,062 | A * | 9/1989 | Holliday | B65D 21/062 220/845 |
| 5,394,913 | A * | 3/1995 | Zezza, Jr. | A45C 13/005 150/118 |
| 8,066,143 | B2 * | 11/2011 | Baltz | B65D 1/22 220/324 |
| 2004/0144793 | A1 * | 7/2004 | Lessard | B65D 43/164 220/836 |
| 2009/0050508 | A1 | 2/2009 | Van Ness | |

OTHER PUBLICATIONS

"25lb Pet Food Container" published online at [http://vannesspets.com/project/dogfc-25lb-pet-food-cont/] retrieved on Jun. 5, 2018, 3 pages.

* cited by examiner

HINGE WITH SNAPPABLY INSERTABLE PIN FOR USE WITH A LID AND CONTAINER

CROSS REFERENCE TO RELATED CASE

This application claims priority to U.S. provisional application No. 62/395,300, filed on Sep. 15, 2016, entitled "HINGE WITH SNAPPABLY INSERTABLE PIN FOR USE WITH A LID AND CONTAINER," the entirety of which is incorporated herein by reference.

TECHNICAL FIELD

This disclosure generally relates to container products, e.g., to a hinge with a snappably insertable pin for use with a lid and container.

BACKGROUND

Containers can be used for storage of various types of materials. In certain circumstances, it can be desirable for a container to have a lid, which can be placed on an opening on the container (e.g., opening at the top of a container) to enable closing or sealing the container to facilitate preventing undesired spillage of the contents of the container and/or to preserve the quality of the contents stored in the container (e.g., preserve freshness of the contents, and/or prevent another material(s) from undesirably being mixed with the contents). It also can be desirable to have an end of the lid be attached to a side of a wall of the container, for example, via a hinge, to facilitate securing the lid to the container and facilitate the opening and closing of the container.

The above-described background is merely intended to provide an overview of contextual information regarding the container products, and is not intended to be exhaustive. Additional context may become apparent upon review of one or more of the various non-limiting embodiments of the following detailed description.

SUMMARY

The following presents a simplified summary to provide a basic understanding of some aspects of the subject disclosure. This summary is not an extensive overview of the disclosed subject matter. It is not intended to identify key or critical elements of the disclosed subject matter, nor is it intended to delineate the scope of the subject disclosure or the claims. Its sole purpose is to present some concepts of the disclosed subject matter in a simplified form as a prelude to the more detailed description presented later.

The disclosed subject matter comprises a container that includes a container component comprising a closed end and side walls associated with and extending away from the closed end, wherein the container component comprises an open end located at first ends of the side walls that are opposite from second ends of the side walls that are associated with the closed end. The container also comprises a lid component configured to at least substantially cover the open end of the container component when the lid component is in a closed position with respect to the container component. The container further comprises a hinge component comprising a pin component that is associated with one of an edge of the lid component or a side wall of the container component, and comprising a base component that is associated another one of the edge of the lid component or the side wall of the container component. The pin component comprises one or more first pin portions that have a first shape and a first size, and one or more second pin portions that have a second shape and a second size that is larger than the first size. The base component comprises one or more base slot components configured to have respective slot open ends into which the one or more second pin portions are insertable to facilitate attachment of the pin component to the base component and formation of the hinge component, and facilitate retention of the one or more second pin portions within the one or more base slot components.

Also disclosed herein is a device comprising a first device component having defined first dimensions that are based at least in part on a use associated with the device. The device also comprises a second device component having defined second dimensions that at least substantially correspond to a portion of the defined first dimensions, based at least in part on the use associated with the device. The device further comprises a hinge component comprising a pin component that is associated with one of a first edge of the first device component or a second edge of the second device component, and comprising a base component that is associated another one of the first edge of the first device component or the second edge of the second device component. The pin component comprises one or more first pin portions that have a first shape and a first size, and one or more second pin portions that have a second shape and a second size that is larger than the first size. The base component comprises one or more base slot components configured to have respective slot open ends into which the one or more second pin portions are able to be inserted to facilitate attachment of the pin component to the base component and formation of the hinge component, and facilitate retention of the one or more second pin portions within the one or more base slot components. The second device component is movable about the hinge component between a first position and a second position with respect to the first device component.

Further disclosed herein is a method comprising forming a container comprising a closed end and side walls having ends associated with the closed end, wherein the side walls extend outward from the closed end, wherein other ends of the side walls of the container are structured in relation to each other to form an open end of the container and are located opposite to the ends of the side walls that are associated with the closed end. The method also comprises forming a lid that is sized and shaped to at least substantially cover the open end of the container when the lid is in a closed position with respect to the container. The method further comprises forming a hinge comprising a pin that is associated with an edge of the lid, and comprising a base that is associated a side wall of the side walls of the container, wherein the pin comprises one or more first pin portions that have a first substantially cylindrical shape and a first size, and one or more second pin portions that have a second substantially cylindrical shape and a second size that is larger than the first size, wherein the base comprises one or more base slots configured to have respective slot open ends into which the one or more second pin portions are insertable to facilitate attachment of the pin to the base and forming the hinge, and facilitate retaining the one or more second pin portions within the one or more base slots when the one or more second pin portions have been inserted in the one or more base slots.

The following description and the annexed drawings set forth in detail certain illustrative aspects of the disclosed subject matter. These aspects are indicative, however, of a few of the various ways in which the principles of the disclosed subject matter may be employed. The disclosed subject matter is intended to include all such aspects and their equivalents. Other advantages and distinctive features of the disclosed subject matter will become apparent from the following detailed description of the disclosed subject matter when considered in conjunction with the drawings.

DETAILED DESCRIPTION

Figure 1:
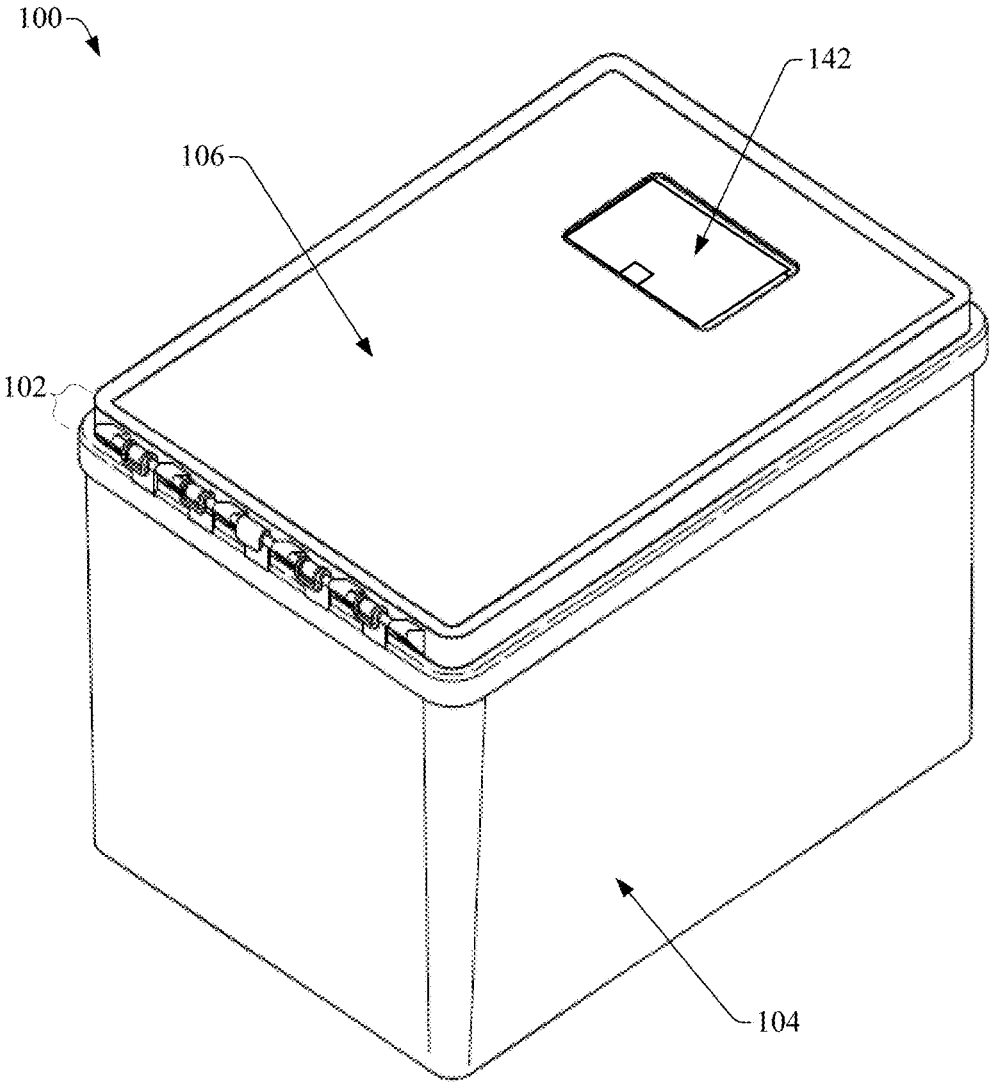
FIG. 1 illustrates a diagram of a view of an example container having a hinge component comprising a pin component associated with a lid component of the storage container and comprising a base component associated with a container component of the container, in accordance with various aspects and embodiments of the disclosed subject matter.

The subject disclosure is now described with reference to the drawings, wherein like reference numerals are used to refer to like elements throughout. In the following description, for purposes of explanation, numerous specific details are set forth in order to provide a thorough understanding of the disclosed subject matter. It may be evident, however, that the disclosed subject matter may be practiced without these specific details. In other instances, well-known structures and devices are shown in block diagram form in order to facilitate describing the disclosed subject matter.

Containers can be used for storage of various types of materials. In certain circumstances, it can be desirable for a container to have a lid, which can be placed on an opening on the container (e.g., opening at the top of a container) to enable closing or sealing the container to facilitate preventing undesired spillage of the contents of the container and/or to preserve the quality of the contents stored in the container (e.g., preserve freshness of the contents, and/or prevent another material(s) from undesirably being mixed with the contents). It also can be desirable to have an end of the lid be attached to a side of a wall of the container, for example, via a hinge, to facilitate securing the lid to the container and facilitate the opening and closing of the container.

Certain types of hinges can be undesirable to use with containers for various reasons. For example, some conventional types of hinges can involve numerous components that can result in the manufacture of the container and lid product being undesirably expensive to produce. As another example, certain conventional types of hinges can be unreliable (e.g., can break apart relatively easily, can make it undesirably difficult to open and close the lid on the container). As still another example, when it is desirable to be able to remove or detach the lid from the container, some types of hinges can make it relatively difficult or cumbersome to remove or detach the lid from the container.

The disclosed subject matter presents a container (e.g., storage container) comprising a hinge component that can desirably secure the lid component of the container with the container component of the container, in accordance with various aspects and embodiments of the disclosed subject matter. The hinge component can comprise a pin component and a base component. In some embodiments, the pin component can be associated with (e.g., attached to, integrated with, formed on) the lid component and the base component can be associated with (e.g., attached to, integrated with, formed on) a wall (e.g., back wall) of the container component. Alternatively, in other embodiments, the pin component can be associated with a wall (e.g., back wall) of the container component and the base component can be associated with the lid component.

The pin component can comprise one or more protruding portions that can extend away from, and/or otherwise be larger in size than, one or more smaller portions of the pin component, wherein the one or more smaller portions can be associated with respective ends of the protruding portions along the pin component. For example, the pin component can comprise protruding portions formed along the pin component with a smaller portion in between protruding portions and/or at the ends of the pin component.

The base component can comprise a recessed portion that can be formed on the base component to have a size and a shape that can correspond to the size and the shape of the pin component. The respective sizes of the protruding portion(s) and the smaller portion(s) of the pin component can facilitate snapping of the pin component into the recessed portion of the base component and retaining the pin component within the recessed portion, while also allowing the lid component to be moved (e.g., desirably and/or easily moved along the hinge component) between the open position and closed position with respect to the open end of the container component with which the lid component is associated.

In some implementations, one or more base slot components can be formed on and along the base component to form or at least partially form the recessed portion of the base component. The respective locations of the one or more base slot components along the base component can correspond to (e.g., align with) the respective locations of the one or more protruding portions along the pin component when the pin component is inserted into the base component to form the hinge component. In some embodiments, the one or more base slot components of the base component each can have an open region (e.g., a cut out region) to accommodate the respective one or more protruding portions of the pin component (e.g., accommodate the relatively larger size of the protruding portion(s), as compared to the smaller size of the smaller portions(s) of the pin component) when the protruding portion(s) of the pin component is inserted into the base slot component(s) of the base component, as more fully described herein.

The pin component can be removably attached to the base component of the hinge component (and on the container component) by inserting and/or snapping the one or more protruding portions of the pin component into the one or more respective base slot components of the base component, wherein the one or more base slot components can retain (e.g., hold) the one or more protruding portions therein to attach the lid component to the container component via the hinge component. If and as desired, the lid component can be removed from the container component by un-snapping the one or more protruding portions of the pin component from the one or more respective base slot components of the base component.

These and other aspects and embodiments of the disclosed subject matter will now be described with respect to the drawings.

Referring to the drawings, FIG. 1 illustrates a diagram of a view of an example container 100 having a hinge component comprising a pin component associated with a lid component of the storage container and comprising a base component associated with a container component of the container, in accordance with various aspects and embodiments of the disclosed subject matter. The container 100 (e.g., storage container) can comprise a hinge component 102 that can be associated with a container component 104 of the container 100 and a lid component 106 of the container 100.

The hinge component 102 can be or comprise a movable joint or mechanism that can enable movement of the lid component 106 about the hinge component 102 to various positions (e.g., closed position, partially open position, open position) in relation to an open end of the container component 104.

The container 100 can be used for one or more purposes, including, for example, storage of various types of products (e.g., food or treats for humans or animals (e.g., pets), medicine for humans for animals, or other solid or liquid products) or materials. The container 100 can be constructed or fabricated from one or more materials, such as, for example, one or more of a polymer-based material (e.g., plastic, rubber, etc.), metal material (e.g., steel, aluminum, copper, etc.), fiberglass material, wood material, etc.

The container 100 can comprise the container component 104, which can be used to store desired products or materials. The container component 104 can comprise a closed end portion with side walls (e.g., 132, 134, 136, and/or 138) that can extend from the closed end portion up to an open end of the container component 104, wherein the closed end portion and side walls can define a space in which the desired products or materials can be inserted and stored. The closed end portion and side walls can be structured in relation to each other so that the container component 104 can have a desired shape (e.g., rectangular or substantially rectangular, square, quadrilateral, trapezoidal, round, oval, irregularly shaped, various differently shaped portions, and/or another desired shape). The closed end portion and side walls each can have a desired height and thickness. In an example embodiment, the container component 104 can have a desired height (e.g., side wall height) of approximately 10.5 inches (or more or less than 10.5 inches), a desired length of approximately 10.0 inches (or more or less than 10.0 inches) (e.g., at the open end portion of the container component 104), and a desired width of approximately 6.5 inches (or more or less than 6.5 inches) (e.g., at the open end portion of the container component 104).

The container 100 can comprise the lid component 106, which can be used to cover or close on the open end of the container component 104 to facilitate preventing spillage of the contents of the container component 104 and/or preserve the quality (e.g., freshness, usability) of the contents (e.g., food) of the container component 104, for example. The lid component 106 can comprise a pin component 108 of the hinge component 102 that can be attached or fastened to a base component 110 of the hinge component 102, wherein the base component 110 can be associated with a side wall (e.g., a back side wall 132) at the top end of such side wall at the open end of the container component 104. The lid component 106 can be moved about the hinge component 102 to cover or close the open end of the container component 104 when in the closed position, and can be moved about the hinge component 102 in the opposite direction to uncover, open, or expose the open end of the container component 104 when the lid component 106 is in the open position with respect to the container component 104. When the lid component 106 is placed in the closed position to cover the open end of the container component 104, the other three side portions of the lid component 106 can be removably attached to or placed on or over the other top ends of the other side walls of the container component 104 to facilitate creating a desirable covering of the open end of the container component 104 by the lid component 106 and/or a desirable seal between the lid component 106 and the container component 104 to facilitate maintaining (e.g., preserving) the freshness or quality of the products or materials stored in the storage container 100. The lid component 106 can have a desired shape, size (e.g., length, width), and thickness, wherein the shape and size of the lid component 106 can correspond to the size and shape of the open end of container component 104 (e.g., the lid component 106 can have a size and shape that can enable the lid component 106 to be larger, by a small amount, in size than the top ends of the walls at the open end of the container component 104, and a shape that corresponds to (e.g., is same as or similar to) the shape of the top ends of the walls at the open end of the container component 104. In some implementations, respective portions of the top ends of at least three walls (e.g., the walls other than the wall of the container component 104 associated with the hinge component 102) of the container component 104 can be insertable (e.g., can be inserted) into a recessed portion (not shown in FIG. 1) of the lid component 106, wherein the recessed portion of the lid component 106 can correspond in size and shape to the respective portions of the top ends of the at least three walls of the container component 104.

The pin component 108 of the hinge component 102 can comprise a cylindrical or substantially cylindrical portion that can be cylindrical or substantially cylindrical in shape. The cylindrical or substantially cylindrical portion of the pin component 108 can be attached to or formed as an extension from a main portion of the lid component 106 on one side of the lid component 108 via one or more support extension components that can extend between the side of the lid component 106 and the cylindrical or substantially cylindrical portion of the pin component 108. In some implementations, the pin component 108 can be formed on and/or integrated with the lid component 106 (as depicted). In other implementations, the pin component 108 can be a separate component that can be attached to the side of the lid component 106.

Figure 2:
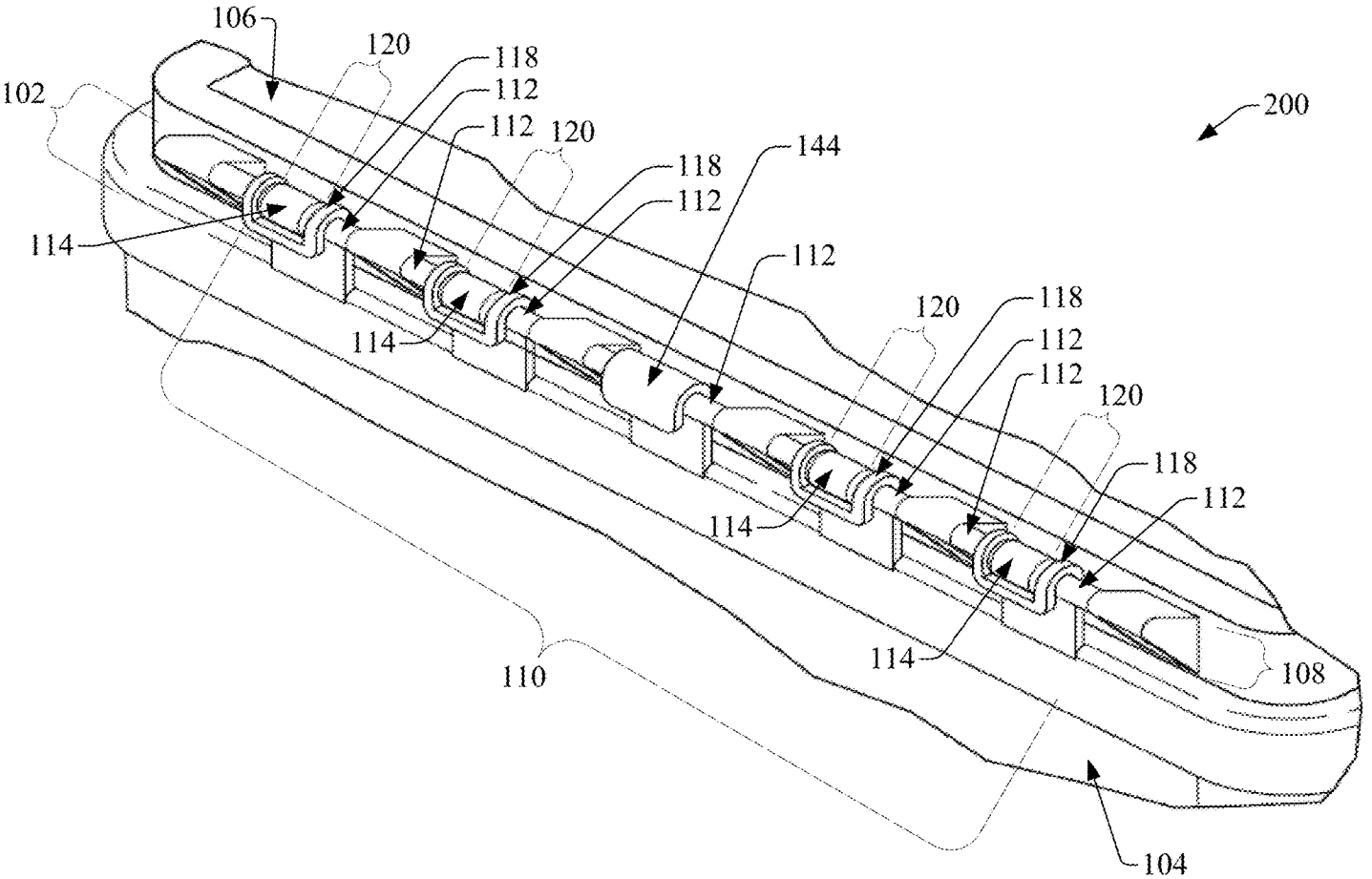
FIG. 2 depicts a diagram of a portion of the example container comprising the example hinge component.
Figure 3:
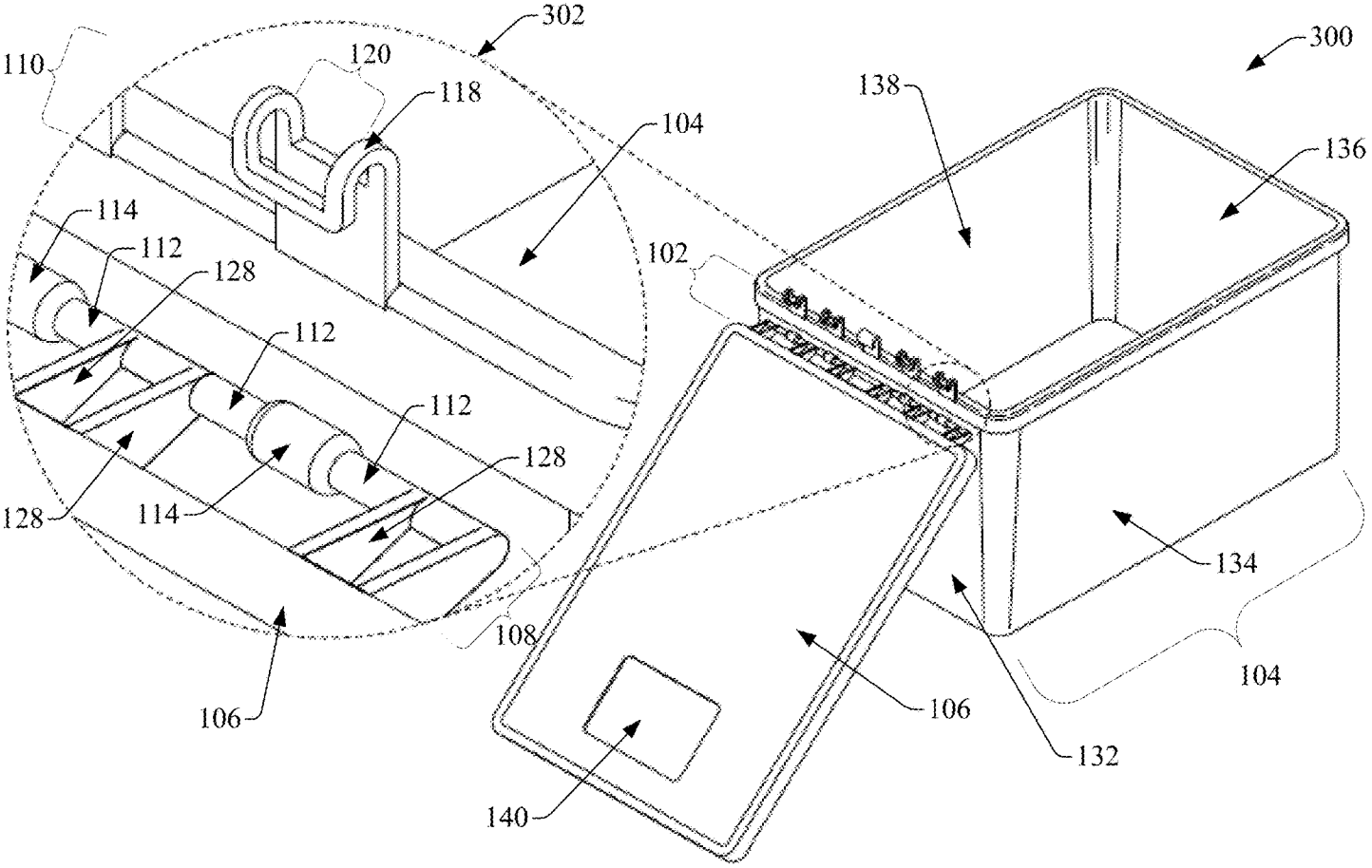
FIG. 3 presents a diagram of an example view of the example container including an exploded view of a portion of the example hinge component of the container with the pin component of the hinge component unattached to the base component of the hinge component, in accordance with various aspects and embodiments of the disclosed subject matter.

Referring to FIGS. 2-10 (as well as FIG. 1), FIG. 2 depicts a diagram of a portion 200 of the example container comprising the example hinge component, in accordance with various aspects and embodiments of the disclosed subject matter. FIG. 3 presents a diagram of an example view 300 of the example container including an exploded view 302 of a portion of the example hinge component 102 of the container 100 with the pin component 108 of the hinge component 102 unattached to the base component 110 of the hinge component 102, in accordance with various aspects and embodiments of the disclosed subject matter.

Figure 4:
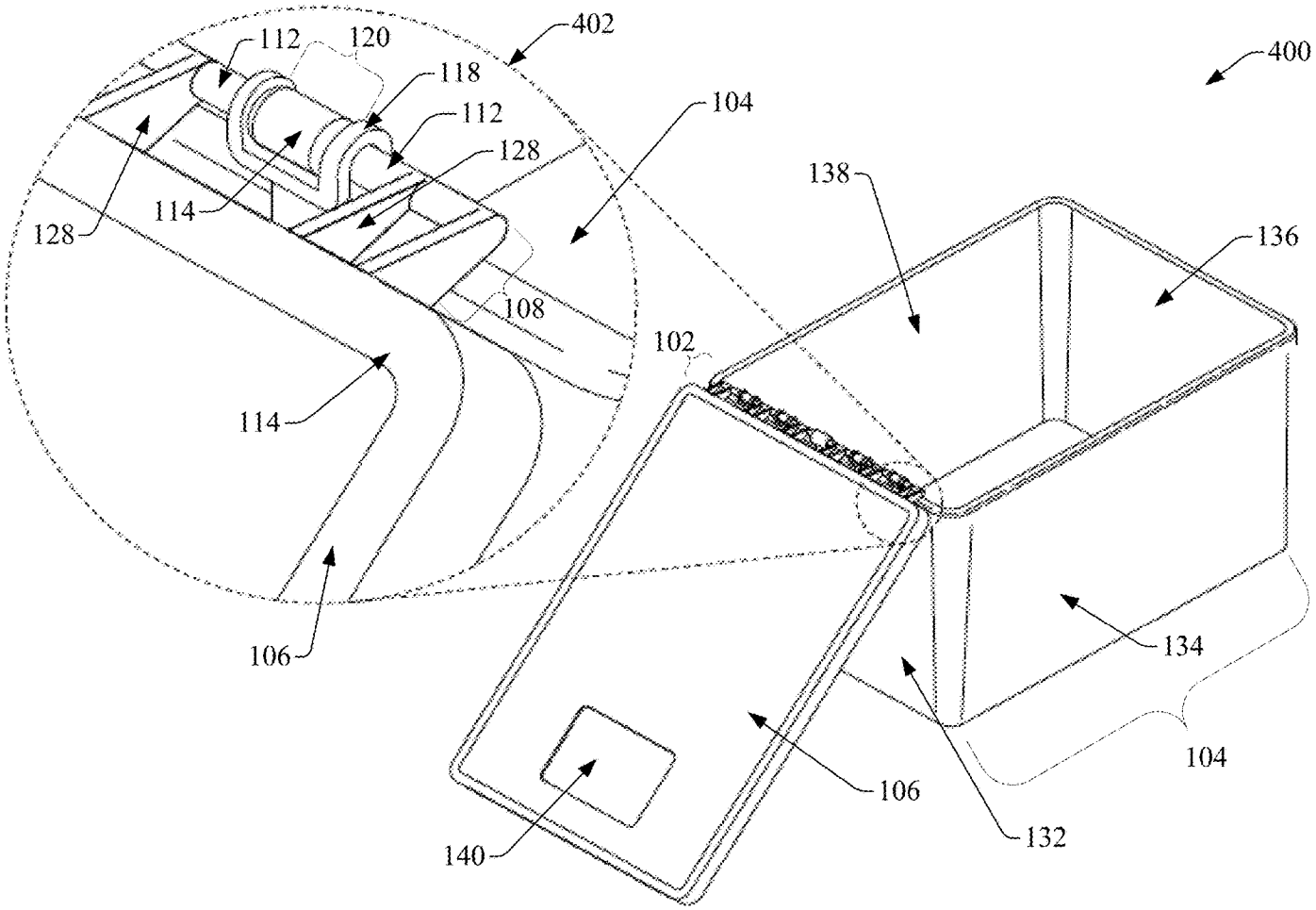
FIG. 4 illustrates a diagram of an example view of the example container including an exploded view of a portion of a hinge component of the container with a pin component of the hinge component attached to a base component of the hinge component, in accordance with various aspects and embodiments of the disclosed subject matter.

FIG. 4 illustrates a diagram of an example view 400 of the example container 100 including an exploded view 402 of a portion of the hinge component 102 of the container 100 with the pin component 108 of the hinge component 102 attached to the base component 110 of the hinge component 102, in accordance with various aspects and embodiments of the disclosed subject matter.

Figure 5:
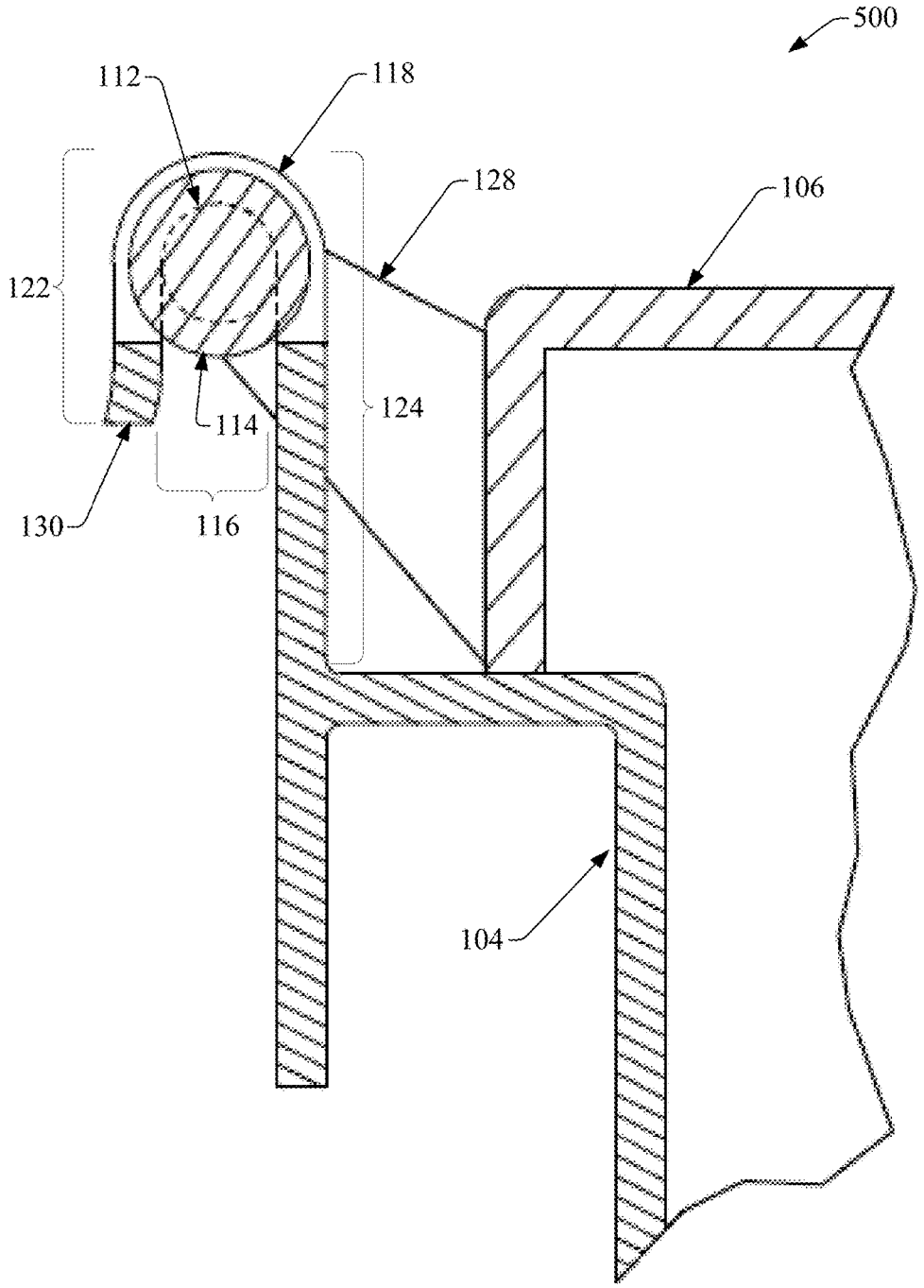
FIG. 5 depicts a diagram of an example side cross-sectional view of a hinge component of a container, in accordance with various aspects and embodiments of the disclosed subject matter.
Figure 6:
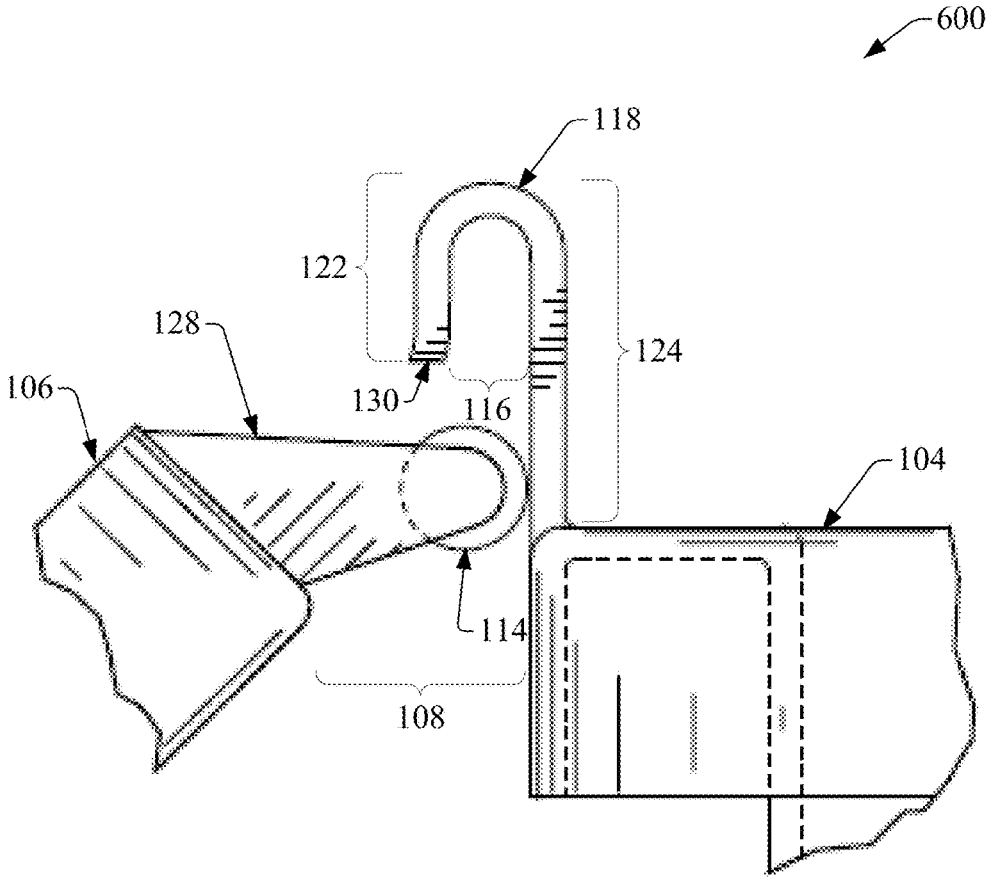
FIG. 6 presents a diagram of a side view of a hinge component of a container with a pin component of the hinge component unattached to a base component of the hinge component, in accordance with various aspects and embodiments of the disclosed subject matter.
Figure 7:
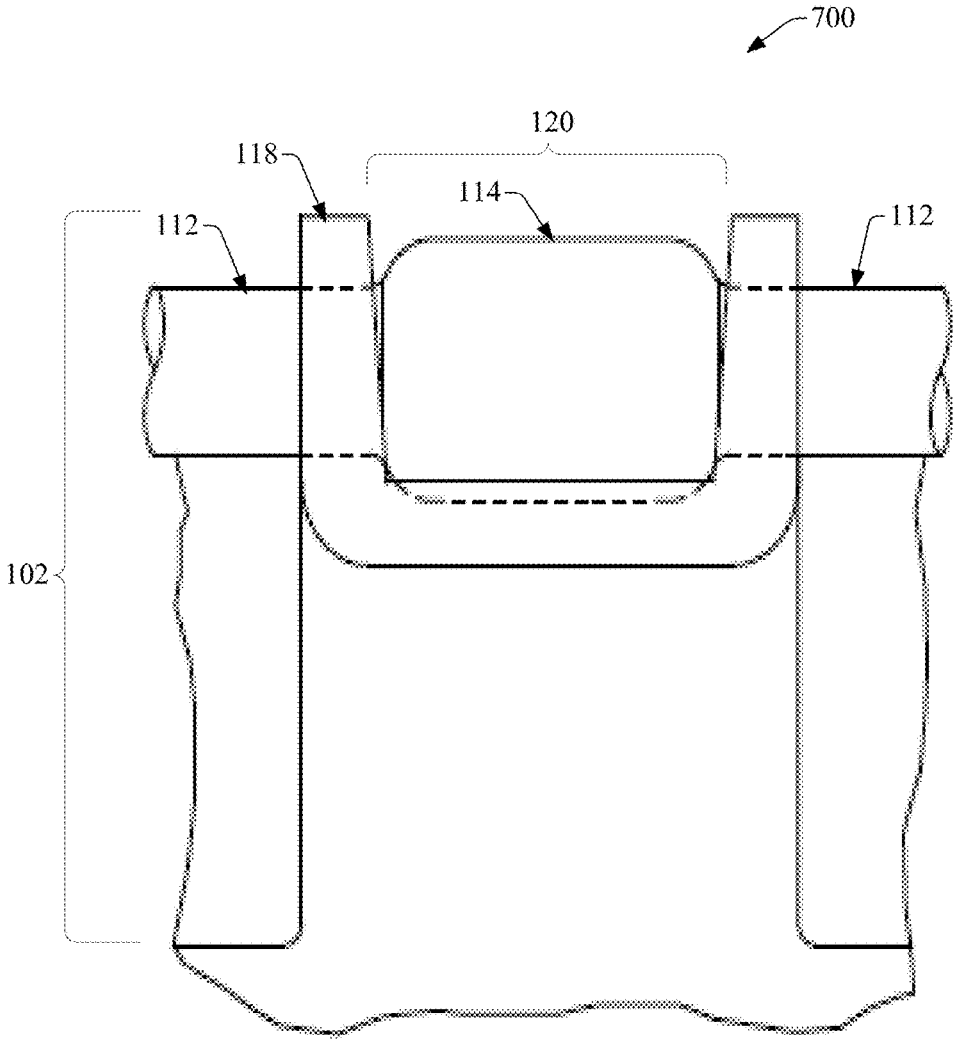
FIG. 7 illustrates a diagram of an example rear view of a portion of an example container comprising a portion of a hinge component, in accordance with various aspects and embodiments of the disclosed subject matter.
Figure 8:
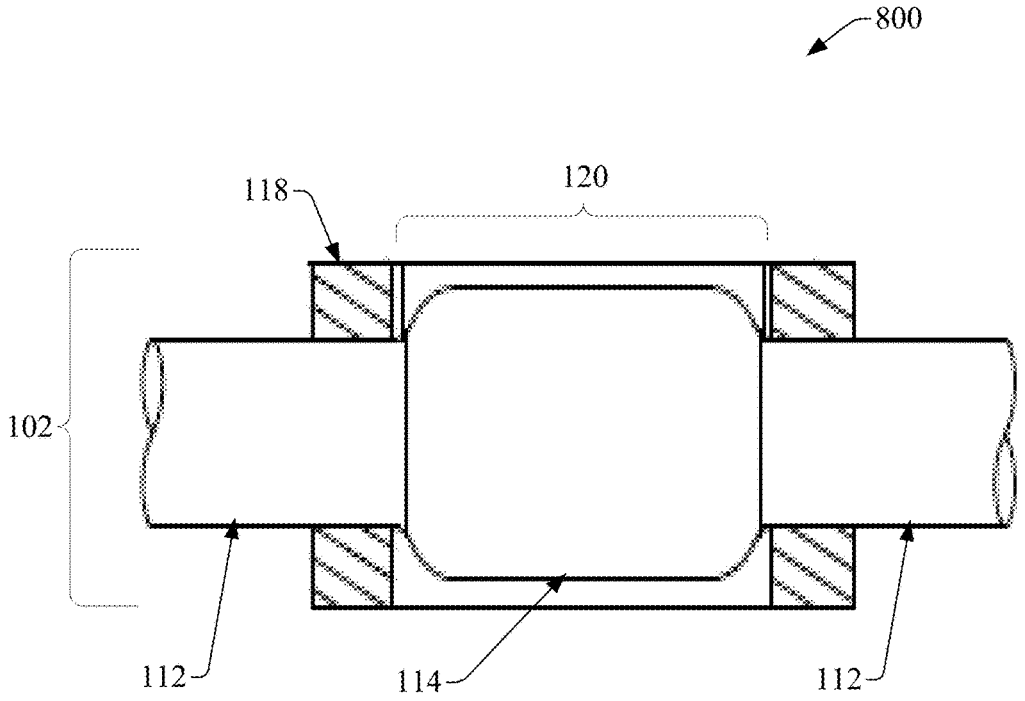
FIG. 8 depicts a diagram of an example bottom view of a portion of an example container comprising a portion of a hinge component, in accordance with various aspects and embodiments of the disclosed subject matter.

FIG. 5 depicts a diagram of an example side cross-sectional view 500 of the example hinge component 102 of the example container 100, in accordance with various aspects and embodiments of the disclosed subject matter. FIG. 6 presents a diagram of an example side view 600 of the example hinge component 102 of the example container 100 with the pin component 108 of the hinge component 102 unattached to the base component 110 of the hinge component 102, in accordance with various aspects and embodiments of the disclosed subject matter. FIG. 7 illustrates a diagram of an example rear view 700 of a portion of the example container 100 comprising a portion of the hinge component 102, in accordance with various aspects and embodiments of the disclosed subject matter. FIG. 8 depicts a diagram of an example bottom view 800 of a portion of the example container 100 comprising a portion of the hinge component 102, in accordance with various aspects and embodiments of the disclosed subject matter.

Figure 9:
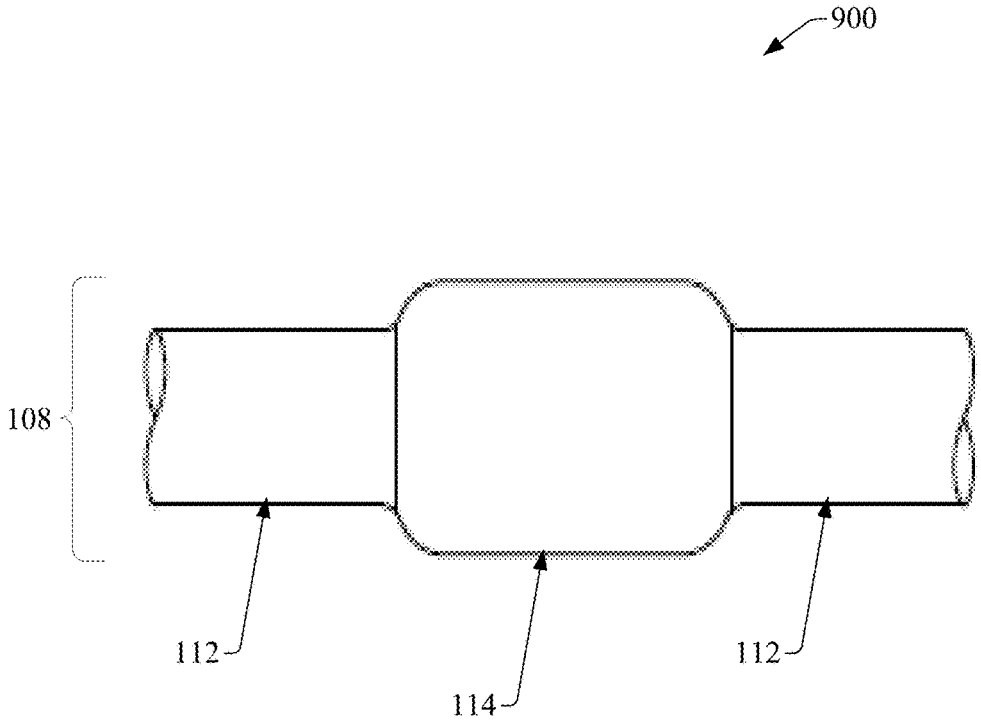
FIG. 9 presents a diagram of a portion of a pin component of an example hinge component, in accordance with various aspects and embodiments of the disclosed subject matter.
Figure 10:
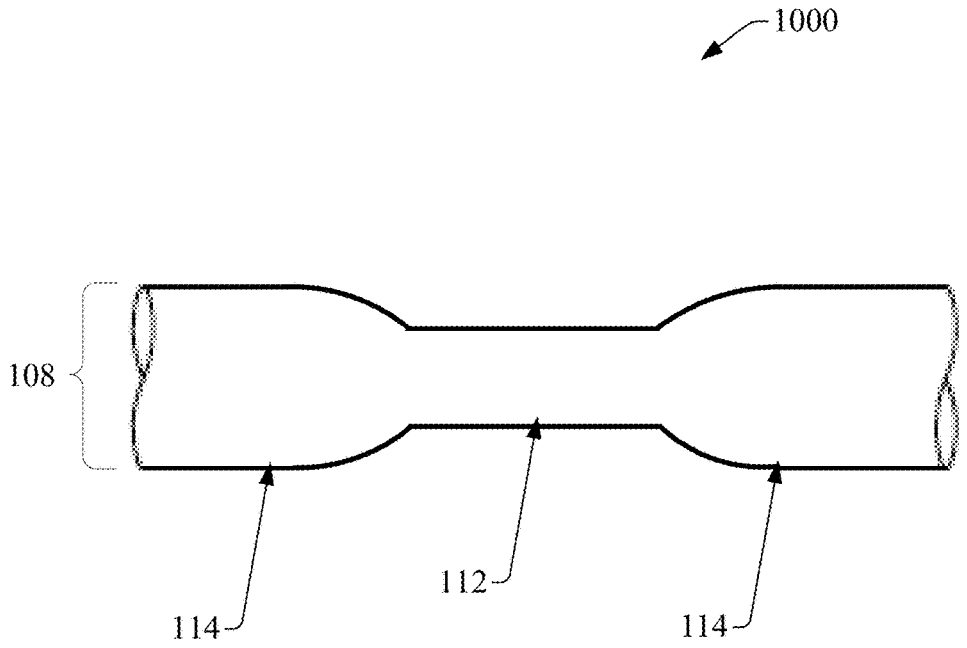
FIG. 10 illustrates a diagram of another portion of an example hinge component, in accordance with various aspects and embodiments of the disclosed subject matter.

FIG. 9 presents a diagram of a portion 900 of the pin component 108 of the example hinge component 102, in accordance with various aspects and embodiments of the disclosed subject matter. FIG. 10 illustrates a diagram of another portion 1000 of the hinge component 102, in accordance with various aspects and embodiments of the disclosed subject matter.

With further regard to FIGS. 1-10, the pin component 108 can comprise one or more first portions 112 (e.g., smaller (e.g., smaller sized) portions) of the pin component 108 that can have a first size (e.g., first diameter or first width) and first shape (e.g., cylindrical or at least substantially cylindrical shape) with regard to the cylindrical or substantially cylindrical portion of the pin component 108 (e.g., the cylindrical or substantially cylindrical part of the one or more first portions 112 can have a first diameter). In between or adjacent to (e.g., adjoined or attached to) the one or more first portions 112 (e.g., first pin portions) of the pin component 108, the pin component 108 can comprise one or more second portions 114 (e.g., second pin portions or protruding portions) of the pin component 108 that can have a second size (e.g., second diameter or second width) and second shape (e.g., cylindrical or at least substantially cylindrical shape) with regard to the cylindrical or substantially cylindrical portion of the pin component 108 (e.g., the cylindrical or substantially cylindrical part of the one or more second portions 114 can have a second diameter), wherein the second diameter can be larger in size than the first diameter by a desired defined amount. For instance, the one or more second portions 114 of the pin component 108 can protrude out cylindrically or at least substantially cylindrically from respective ends of respective first portions 112 of the pin component 108 by a desired defined differential amount such that the one or more second portions 114 can be and can appear enlarged in relation to the one or more first portions 112 of the pin component 108. The relative differences in size between the first size of the one or more first portions 112 and the second size of the one or more second portions 114 of the pin component 108 can facilitate snapping of the pin component 108 into a recessed portion 116 (e.g., recessed area or region) of the base component 110, while maintaining (e.g., retaining or holding) the pin component 108 within the recessed portion 116 of the base component 110 after the pin component 108 is snapped (e.g., removably snapped) into the recessed portion 116 of the base component 110, and while also allowing the lid component 106 to be moved (e.g., relatively easily moved) between the open position and closed position with respect to the container component 104 while the pin component 108 is located within the recessed portion 116 of the base component 110.

In some implementations, the base component 110 can be formed on and/or integrated with the container component 104 (as depicted). In other implementations, the base component 110 can be a separate component that can be attached to the side (e.g., at or near the top end of the rear side) of the container component 104. The base component 110 can comprise one or more base slot components 118 that can be formed on the base component 110 in one or more respective regions of (e.g., along) the base component 110 that can correspond to (e.g., be aligned with) the respective locations of the one or more second portions 114 on (e.g., along) the pin component 108. The one or more base slot components 118 can be formed to comprise an open region 120 that can be sized and shaped to accommodate a respective (e.g., corresponding) second portion 114 of the pin component 108 when the pin component 108 is snapped and inserted (e.g., removably inserted) into the recessed portion 116 of the base component 110, wherein the one or more second portions 114 of the pin component 108 can be inserted (e.g., removably inserted), at least partially, into the one or more respective open regions 120 of the one or more respective base slot components 118 of the base component 110. The base slot components 118 can be formed to be shaped to be curved, at least in part, in a semi-circular or at least a substantially semi-circular shape to form the recessed portion 116 of the base component 110, wherein the recessed portion 116 can span a defined length between a first side portion 122 (e.g., the free, extended, and/or flared side) of the semi-circular portion and a base portion portion 124 (e.g., the portion of the base slot component 118 on the opposite side associated with (e.g., connected to or integrated with) the top end of the side wall) of the semi-circular portion of the one or more respective base slot components 118. The defined length between the respective sides of the semi-circular portion of the one or more respective base slot components 118 can be smaller (e.g., relatively smaller) in size than the second diameter of the one or more second portions (e.g., protruding portions) of the pin component 108 and can correspond or substantially correspond in size (e.g., can be slightly larger in size) than the one or more first portions 112 (e.g., smaller sized portions) of the pin component 108 to facilitate enabling the one or more first portions 112 of the pin component 108 to be moved while within the recessed portion 116 of the base component 110.

Forming the one or more base slot components 118 to have the recessed portion 116 spanning the defined length from the first side portion 122 of the semi-circular portion to the base portion 124 (e.g., opposite or second side portion) of the semi-circular portion of the one or more respective base slot components 118 can facilitate enabling the one or more second portions 114 of the pin component 108 to be snapped (e.g., removably snapped) into the recessed portion 116 of the one or more base slot components 118, as the one or more base slot components 118 can be configured or formed to be sufficiently flexible at the open end of the recessed portion 116 of the one or more base slot components 118 to move (e.g., move slightly) to allow the one or more larger-sized second portions 114 (e.g., second pin portions) of the pin component 108 to be inserted (e.g., snappably inserted) into the recessed portion 116 of the one or more base slot components 118, yet the one or more base slot components 118 can be sufficiently rigid in construction to maintain (e.g., retain or hold) the one or more second portions 114 of the pin component 108 in the recessed portion 116 (e.g., and in, or at least partially in, the one or more respective open regions 120) of the base slot components 118 after the one or more second portions 114 have been inserted into the one or more base slot components 118. Also, forming the one or more base slot components 118 to have the recessed portion 116 spanning the defined length from the first side portion 122 of the semi-circular portion to the base portion 124 (e.g., opposite side portion) of the semi-circular portion of the one or more respective base slot components 118 can facilitate enabling the one or more first portions 112 (e.g., first pin portions) of the pin component 108 to move (e.g., rotate) within the recessed region 116 of the one or more base slot components 118 (e.g., the respective portions of the one or more base slot components 118 that surround and define the one or more respective open regions 120 of the one or more base slot components 118) to enable the lid component 106 to be moved about the hinge component 102 between the open position and closed position with respect to the container component 104. Further, forming the one or more base slot components 118 to have the one or more respective open regions 120 formed in the one or more respective base slot components 118 to accommodate the one or more second portions of the pin component 108 can facilitate enabling the one or more first portions 112 of the pin component 108 to move (e.g., rotate) within the respective recessed portions 116 of the one or more respective base slot components 118 and enabling the one or more second portions 114 of the pin component 108 to move (e.g., rotate) with the one or more respective open regions 120 of the one or more base slot components 118 to enable the lid component 106 to be moved about the hinge component 102 between the open position and closed position with respect to the container component 104.

In accordance with various aspects and embodiments, the base component 110 of the hinge component 102 can be associated with (e.g., formed on, integrated with, or attached to) the container component 104 of the container 100, and the pin component 108 of the hinge component 102 can be associated with (e.g., formed on, integrated with, or attached to) the lid component 106 of the container 100. The cylindrical or substantially cylindrical portion of the pin component 108 can be attached to or formed as an extension from a main portion 126 (e.g., main body) of the lid component 106 on or in proximity to one side (e.g., rear side) of the lid component 106 via one or more support extension components 128 that can extend between the side (e.g., an edge of the side) of the main body 126 of the lid component 106 and the cylindrical or substantially cylindrical portion (e.g., the one or more first portions 112) of the pin component 108.

In some implementations, an open region 120 of a base slot component 118 can be sized and/or shaped to be wider (e.g., relatively wider) in length at the top part of the base slot component 118 than at or near the bottom part of the base slot component 118 where the open region 120 ends, wherein the top part of the base slot component 118 can be the middle or highest point of the semi-circular portion of the base slot component 118, and wherein the bottom part of the base slot component 118 where the open region 120 can end or can be bordered at or near the end portion 130 of the base slot component 118 on the first side portion 122 of the base slot component 118 and at a corresponding location on the base portion 124 (e.g., opposite side portion across from the first side portion 122) of the base slot component 118. That is, for example, the inner walls of the base slot component 118 that define, in part the open region 120 can be respectively angled at respective desired angles (e.g., 5°, 10°, −5°, −10°, or another defined angle) such that the open region 120 can be wider at the top of the base slot component 118 than at or near the bottom part of the base slot component 118 where the open region 120 ends.

In certain implementations, with respect to the base portion 124 on the one side of the semi-circular portion of the base slot component 118, an end portion 130 of the first side portion 122 of the base slot component 118 can be flared or extended outward (e.g., relatively slightly outward) away from the base portion 124. This flaring or extending out of the end portion 130 (e.g., edge portion) away from the base portion 124 can facilitate enabling a second portion 112 of the pin component 108 to be inserted or snapped into the base slot component 118.

In some embodiments, the lid component 106 can have a hole region 140 formed thereon to facilitate removing contents from (e.g., pouring contents out of) or adding contents to the container component 104 without opening the lid component 106. The hole region 140 can have desired dimensions (e.g., width, length, and/or diameter) and a desired shape (e.g., rectangular, square, quadrilateral, irregular, and/or rounded). The lid component 106 also can comprise a smaller lid component 142 (e.g., as depicted in FIG. 1) that can be inserted into the hole region 140 (e.g., as depicted in FIG. 3) and attached to the lid component 106 to facilitate covering and/or sealing the hole region 140 when the smaller lid component 142 is in a closed position with respect to the lid component 106 and hole region 140. For example, there can be pins (not shown) on edges of respective (e.g., opposite) sides of the smaller lid component 142 that can be inserted into recessed regions (not shown) of the lid component 106 formed in proximity to the hole region 140 to attach the smaller lid component 142 to the lid component 106. The smaller lid component 142 can be moved from the closed position to an open position (e.g., exposing all or part of the hole region 140) by moving the smaller lid component 142 about the hinges formed by the pins of the smaller lid component 142 and the recessed regions of the lid component 106 in which the pins can be inserted.

In certain embodiments, in addition to the base component 110 comprising one or more base slot components 118, the base component 110 also can comprise a base guide component 144 that can facilitate maintaining (e.g., retaining) at least a portion of the pin component 108 (e.g., a first pin portion 112 of the one or more first pin portions) within the base component 110, and/or can facilitate providing a desirable level of ease and stability of movement of the pin component 108 within the recessed region 116 of the base component with respect to opening and closing of the lid component 106 in relation to the container component 104, when the pin component 108 is inserted in the recessed region 116 of the base component 110. In some implementations, the base guide component 144 can be substantially similar in size and shape to a base slot component 118, but does not include an open region like a base slot component 118 can have, as a first pin portion 112 can be inserted into the base guide component 144, as opposed to a second pin portion 114.

While the containers disclosed herein have primarily been shown to have walls that are, at least in part, flat or substantially flat in various wall regions, the disclosed subject matter is not so limited. In accordance with various implementations and embodiments, one or more of the walls of a container component can be structured differently, and accordingly, a lid component can be formed to have a shape and dimensions that can correspond or at least substantially correspond to the particular shape and dimensions of the container component (e.g., the open end of the container component). For example, a container component can comprise a wall (e.g., rear wall) that can be flat or at least substantially flat, wherein such wall can be associated with another wall of the container component, wherein such other wall can be different (e.g., semi-circular, semi-oval, semi-elliptical, irregular, triangular, or tri-lateral) in shape (e.g., at the open end of the container component). Based at least in part on such shape and dimensions of the container component, the lid component can be correspondingly shaped and sized to be used to cover the open end of the lid component.

While the disclosed subject matter has been described herein primarily with regard to containers that can be used for storage, the disclosed subject matter is not so limited. In accordance with various implementations and embodiments, the disclosed subject matter can comprise a device or system that can employ a hinge component, such as the hinge component (e.g., 102) disclosed herein. The device or system can be or can comprise, for example, a door and door frame, a sensor (e.g., light sensor, camera, audio sensor), lighting device, or other device that can have its position adjusted via a hinge component.

For example, a device or system can comprise a first component (e.g., first device component) that can have defined first dimensions that are based at least in part on a use associated with the device or system. A second component (e.g., second device component) having defined second dimensions that at least substantially correspond to a portion of the defined first dimensions, based at least in part on the use associated with the device or system. The device or system also can comprise a hinge component (e.g., 102) that can comprise a pin component (e.g., 108) that can be associated with one of a first edge of the first component or a second edge of the second component, and can comprise a base component (e.g., 110) that can be associated another one of the first edge of the first component or the second edge of the second component. The pin component can comprise one or more first pin portions (e.g., 112) that can have a first shape and a first size, and one or more second pin portions (e.g., 114) that can have a second shape and a second size that can be larger than the first size. The base component can comprise one or more base slot components (e.g., 118) that can be configured to have respective slot open ends into which the one or more second pin portions are able to be inserted to facilitate attachment of the pin component to the base component and formation of the hinge component, and facilitate retention of the one or more second pin portions within the one or more base slot components. The second component can be movable about the hinge component between various positions, including a first position (e.g., closed position) and a second position (e.g., open position), with respect to the first component.

These and other extended uses of the disclosed hinge component with various devices and systems are considered part of the disclosed subject matter.

As can be observed with regard to the hinge component 102, it is not necessary for the end portion of the semi-circular portion of a base slot component 118 to have an inward protruding lip portion (e.g., catch or retaining portion) that would protrude inward into the recessed portion 116 and toward the opposite end of the semi-circular portion of the base slot component 118, due at least in part to the second portion(s) 114 being larger in diameter than the first portion(s) 112 and the open region(s) 120 that can accommodate the larger-sized second portion(s) 114 of the pin component 108.

Figure 11:
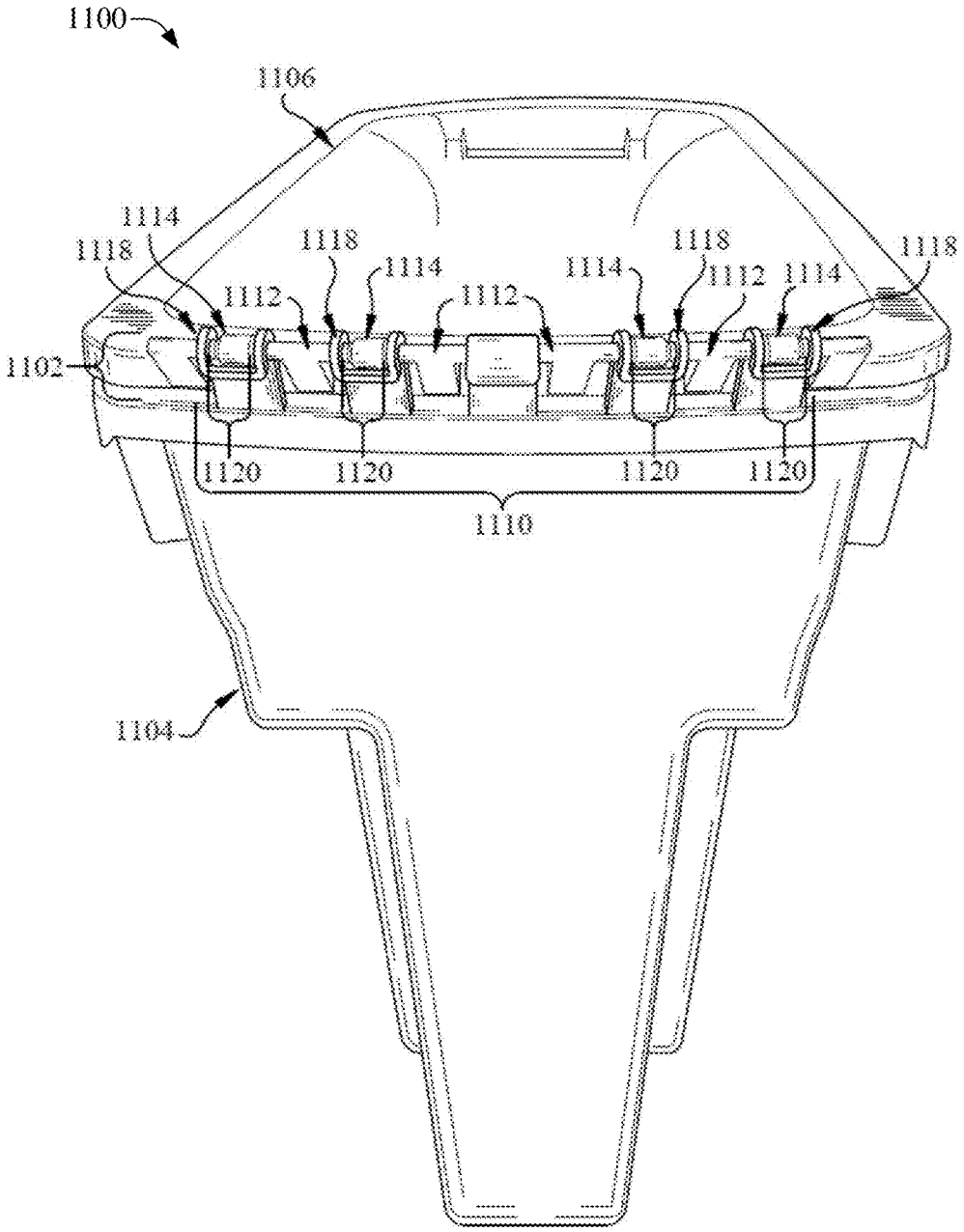
FIG. 11 depicts an image of a back view of a container that can comprise a hinge component, which can include a pin component associated with a lid component of the container and a base component associated with a container component of the container, in accordance with various aspects and embodiments of the disclosed subject matter.
Figure 12:
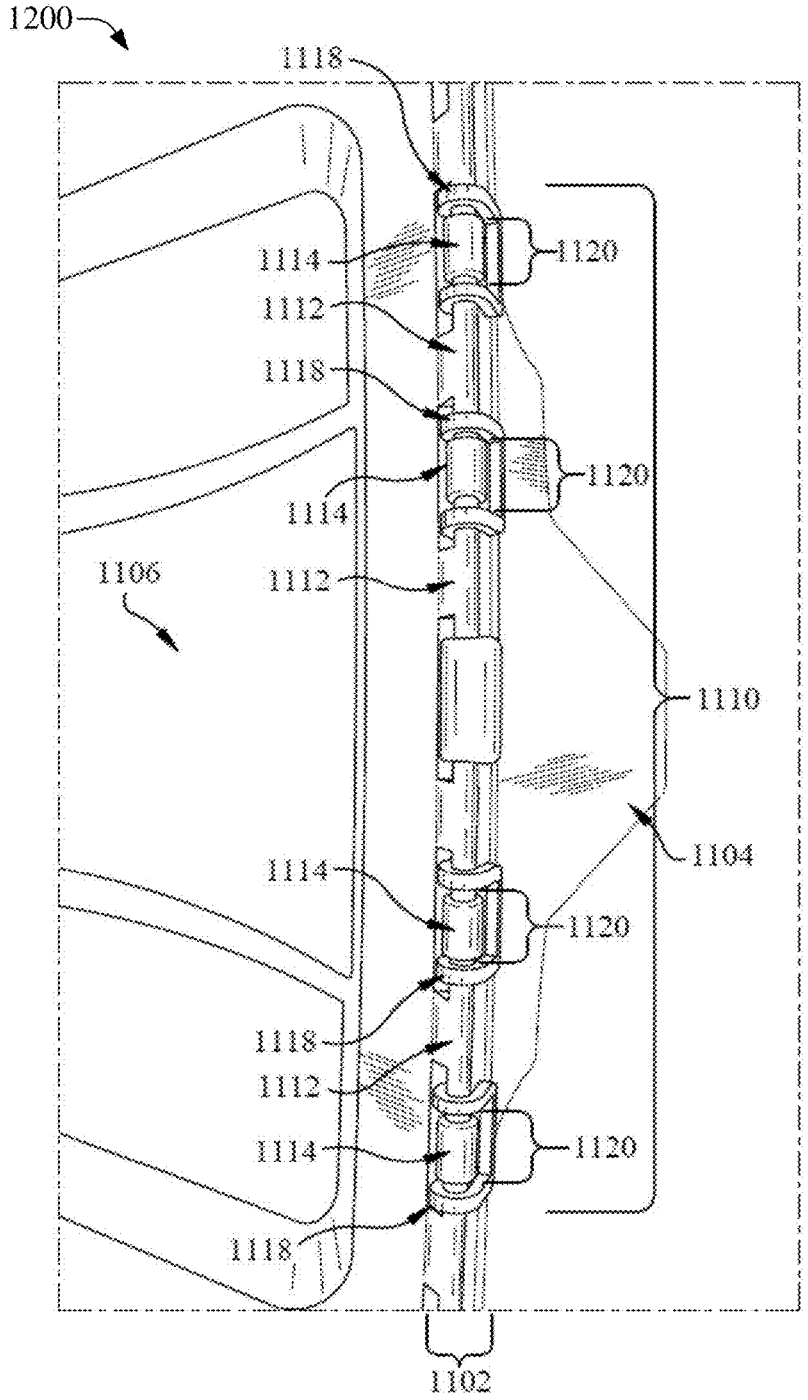
FIG. 12 illustrates an image of a relatively closer aerial view of a hinge component of a container, in accordance with various aspects and embodiments of the disclosed subject matter.
Figure 13:
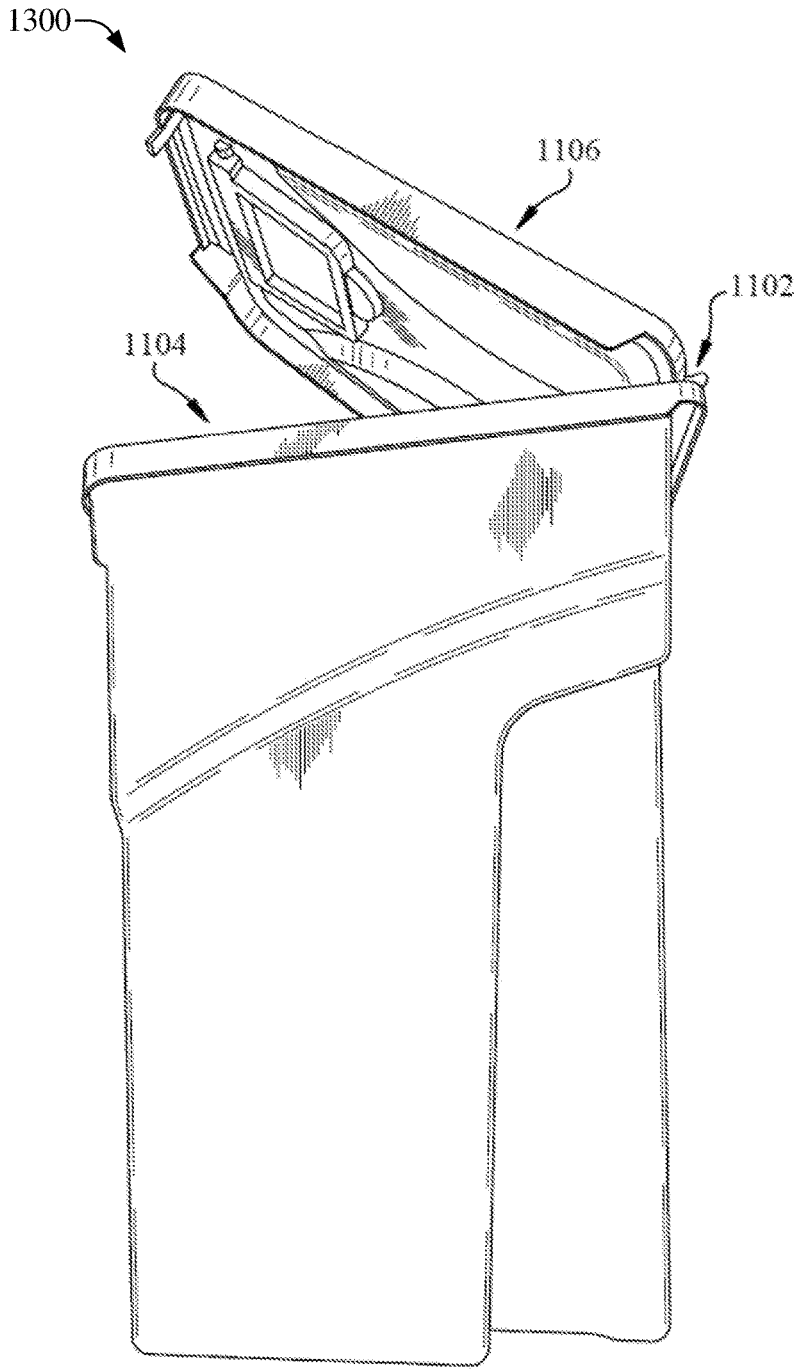
FIG. 13 depicts an image of a side view of a container comprising a container component and a lid component, wherein with the lid component is in an open or at least partially open position with respect to the container component, in accordance with various aspects and embodiments of the disclosed subject matter.

Turning to FIGS. 11-18, FIGS. 11, 12, and 13 are illustrations of various different views of an example container 1100 (e.g., storage container) that can comprise a hinge component, which can include a pin component associated with a lid component of the storage container and a base component associated with a container component of the container, in accordance with various aspects and embodiments of the disclosed subject matter. FIG. 11 depicts an image of a back view of the container 1100. FIG. 12 illustrates an image 1200 of a relatively closer aerial view of the hinge component 102 of the container 1100. FIG. 13 depicts an image 1300 of a side view of the container 1100 comprising a container component 1104 and a lid component 1106, wherein with the lid component 1106 is in an open or at least partially open position with respect to the container component 1104.

Figure 14:
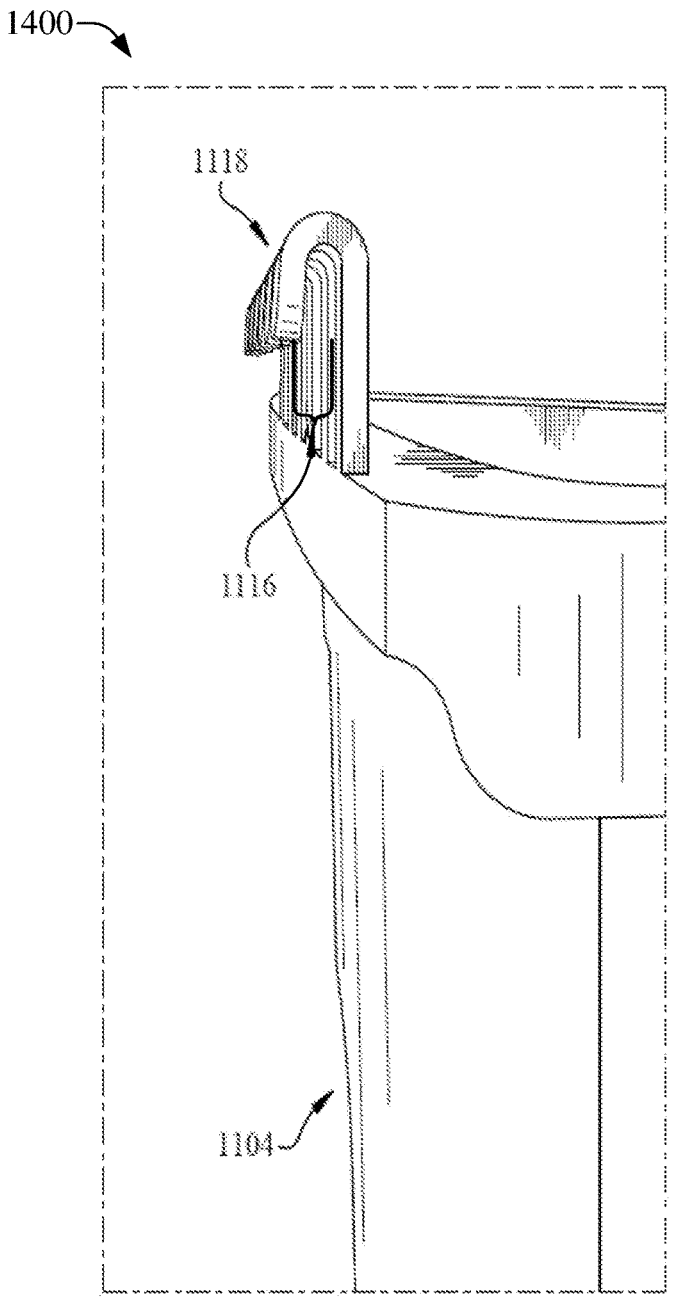
FIG. 14 presents an image of a side view of a base component of a hinge component, in accordance with various aspects and embodiments of the disclosed subject matter.
Figure 15:
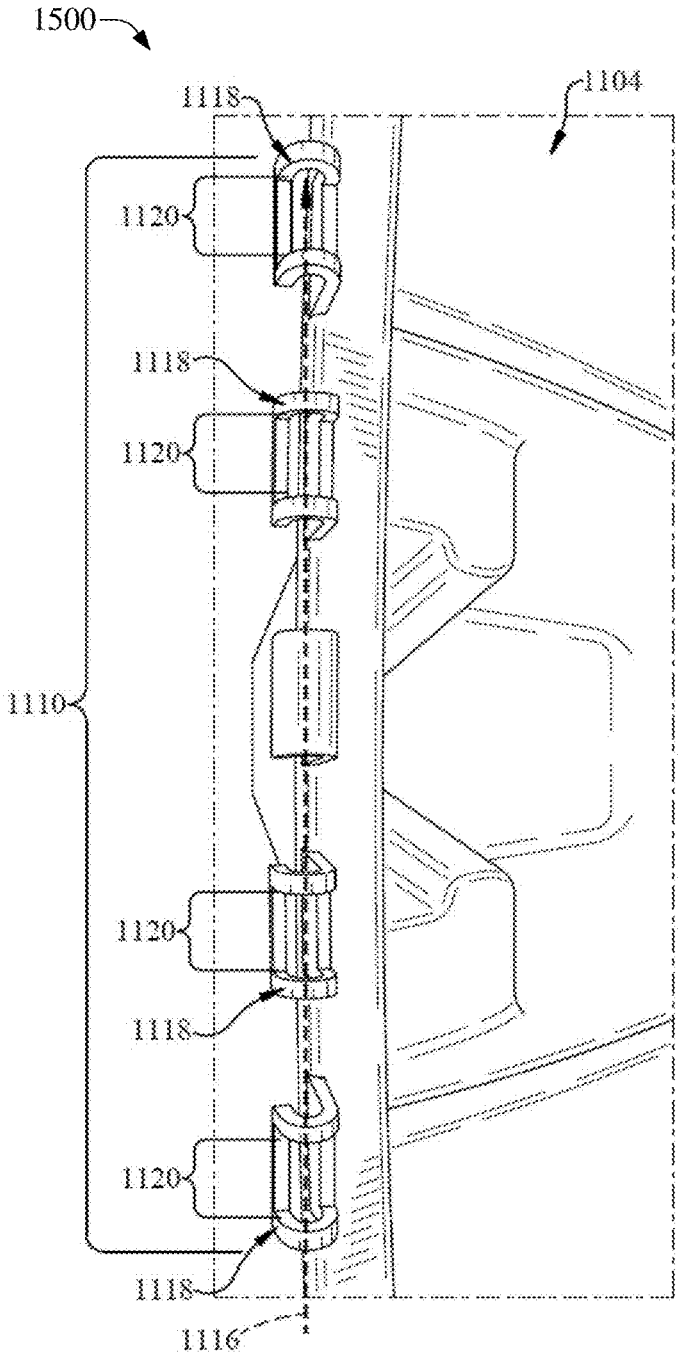
FIG. 15 depicts an image of a top view of a base component of a hinge component, in accordance with various aspects and embodiments of the disclosed subject matter.

FIGS. 14 and 15 depict illustrations of different views of an example base component 1110 of the hinge component 1102, in accordance with various aspects and embodiments of the disclosed subject matter. FIG. 14 presents an image 1400 of an illustration of a side view of the base component 1110 of the hinge component 1102. FIG. 15 depicts an image 1500 of a top view of the base component 1110 of the hinge component 1102.

Figure 16:
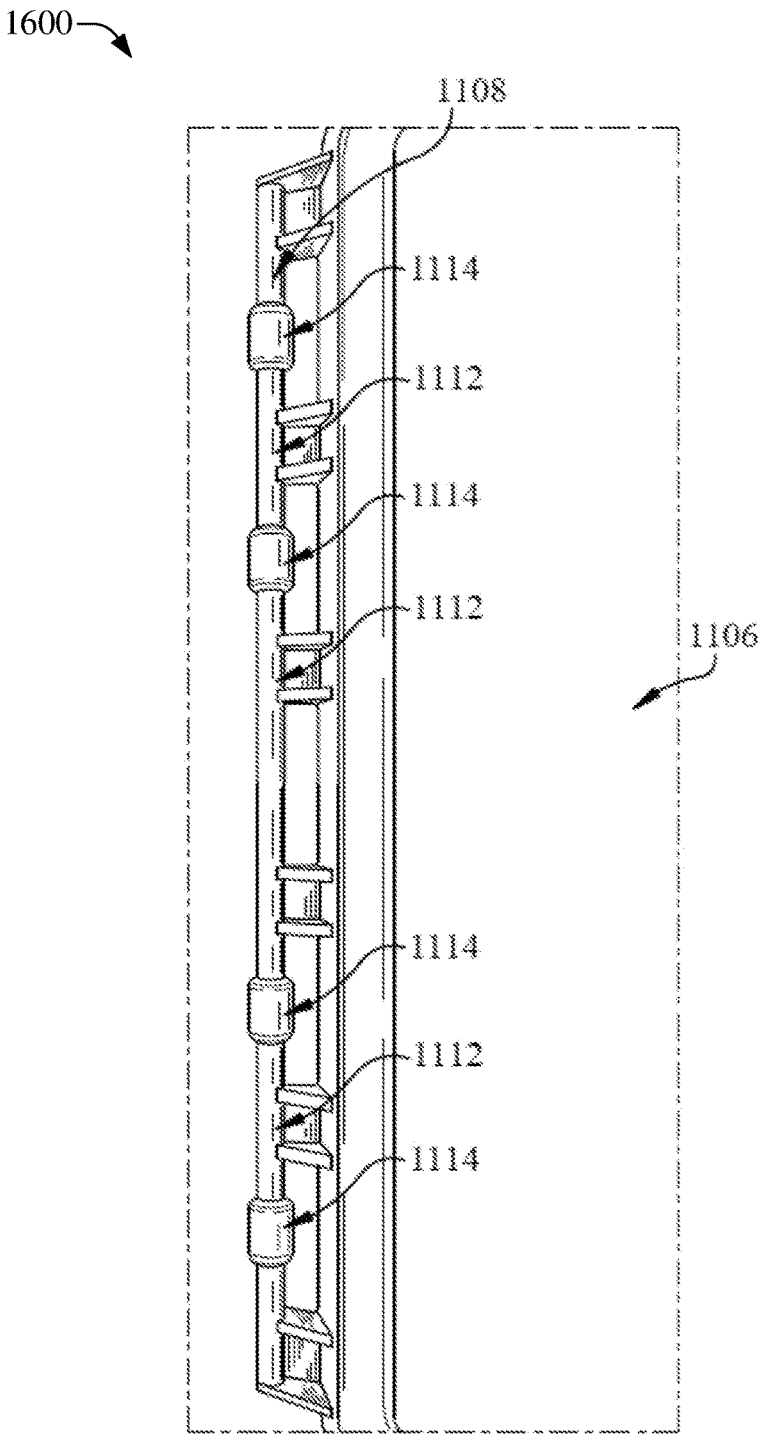
FIG. 16 depicts an image of a bottom view of a pin component, in accordance with various aspects and embodiments of the disclosed subject matter.
Figure 17:
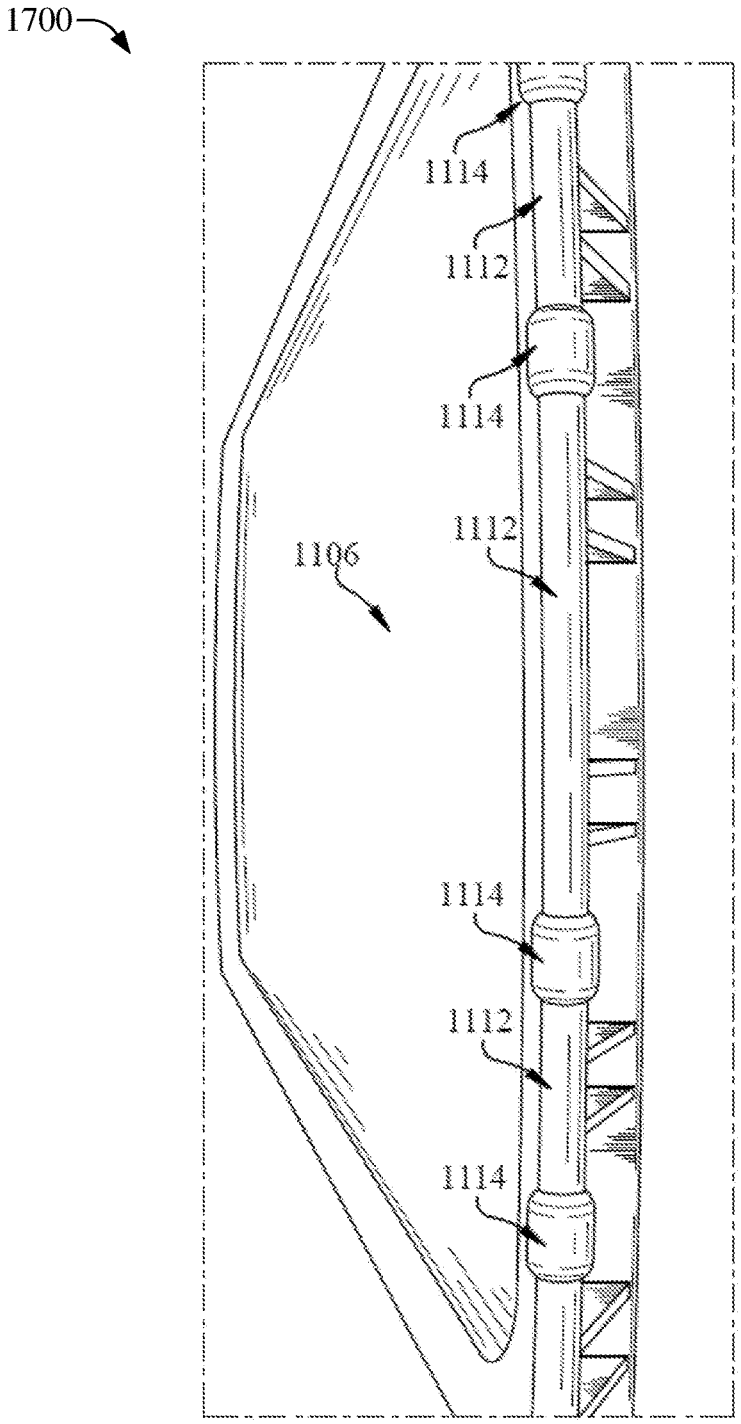
FIG. 17 presents an image of a front view of a pin component, in accordance with various aspects and embodiments of the disclosed subject matter.
Figure 18:
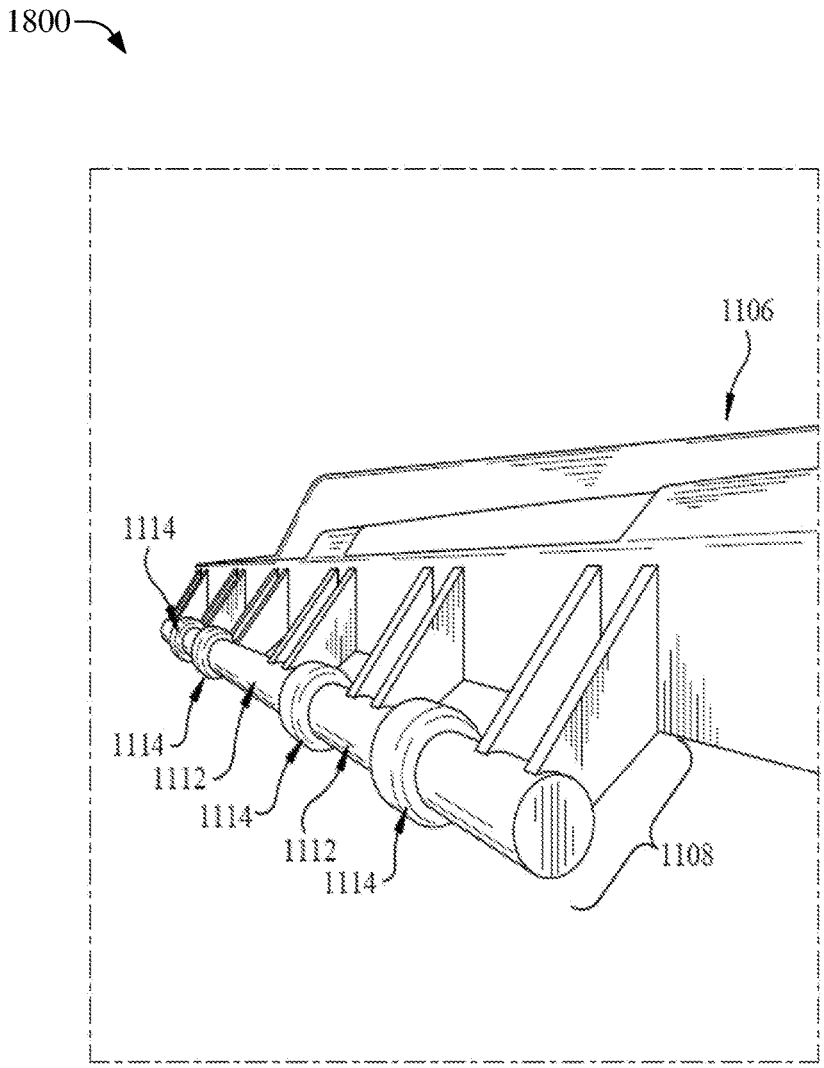
FIG. 18 depicts an image of a side view (e.g., a substantially side view) of a pin component, in accordance with various aspects and embodiments of the disclosed subject matter.

FIGS. 16, 17, and 18 present illustrations of different views of an example pin component 1108 of the hinge component 1102 that can be part of the lid component 1106, in accordance with various aspects and embodiments of the disclosed subject matter. FIG. 16 depicts an image 1600 of a bottom view of the pin component 1108. FIG. 17 presents an image 1700 of a front view of the pin component 1108. FIG. 18 depicts an image 1800 of a side view (e.g., a substantially side view) of the pin component 1108.

The hinge component 1102, container component 1104, lid component 1106, pin component 1108, base component 1110, one or more first portions 1112 (e.g., first pin portions), one or more second portions 1114 (e.g., second in portions), one or more recessed regions 1116, one or more base slot components 1118, one or more open regions 1120, and other components (e.g., support extension component(s), first side portion and base portion of the base component, . . . ) of the container 1100 can be same as or similar to, and/or can comprise the same or similar functionality or features of, respective components (e.g., respectively named components), such as more fully described herein, in accordance with various aspects and embodiments of the disclosed subject matter.

The aforementioned systems and/or devices have been described with respect to interaction between several components (e.g., container component, hinge component, base component, pin component, base slot component, walls, recessed portion, etc.). It should be appreciated that such systems and components can include those components or sub-components specified therein, some of the specified components or sub-components, and/or additional components. Sub-components could also be implemented as components communicatively coupled to other components rather than included within parent components. Further yet, one or more components and/or sub-components may be combined into a single component providing aggregate functionality. The components may also interact with one or more other components not specifically described herein for the sake of brevity, but known by those of skill in the art.

Figure 19:
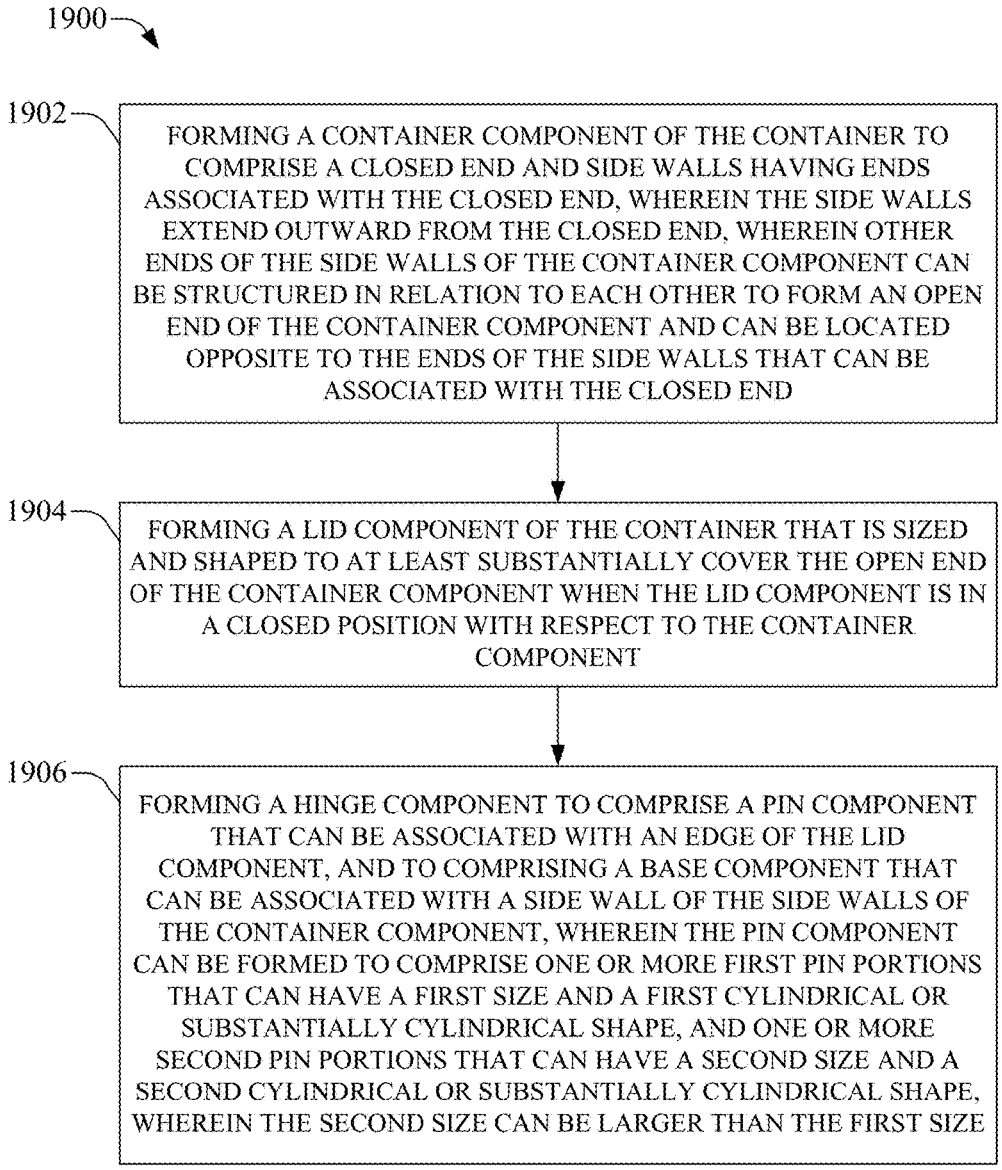
FIG. 19 illustrates a flow diagram of an example method for forming a container comprising a hinge component, in accordance with various embodiments and aspects of the disclosed subject matter.

In view of the example components, devices, and systems described herein, example methods that can be implemented in accordance with the disclosed subject matter can be better appreciated with reference to flowcharts in FIG. 19. For purposes of simplicity of explanation, example methods disclosed herein are presented and described as a series of acts; however, it is to be understood and appreciated that the disclosed subject matter is not limited by the order of acts, as some acts may occur in different orders and/or concurrently with other acts from that shown and described herein. For example, a method disclosed herein could alternatively be represented as a series of interrelated states or events, such as in a state diagram. Moreover, interaction diagram(s) may represent methods in accordance with the disclosed subject matter when disparate entities enact disparate portions of the methods. Furthermore, not all illustrated acts may be required to implement a method in accordance with the subject specification.

FIG. 19 illustrates a flow diagram of an example method 1900 for forming a container comprising a hinge component, in accordance with various embodiments and aspects of the disclosed subject matter. At 1902, a container component of the container can be formed to comprise a closed end and side walls having ends associated with the closed end, wherein the side walls extend outward from the closed end, wherein other ends of the side walls of the container component can be structured in relation to each other to form an open end of the container component and can be located opposite to the ends of the side walls that can be associated with the closed end.

At 1904, a lid component of the container can be formed that is sized and shaped to at least substantially cover the open end of the container component when the lid component is in a closed position with respect to the container component.

At 1906, a hinge component can be formed to comprise a pin component that can be associated with an edge of the lid component, and to comprising a base component that can be associated with a side wall of the side walls of the container component, wherein the pin component can be formed to comprise one or more first pin portions that can have a first size (e.g., first diameter) and a first cylindrical or substantially cylindrical shape, and one or more second pin portions that can have a second size (e.g., second diameter) and a second cylindrical or substantially cylindrical shape, wherein the second size can be larger than the first size.

The base component can comprise one or more base slot components that can be configured to have respective slot open ends into which the one or more second pin portions can be insertable to facilitate attachment of the pin component to the base component and forming the hinge component, and facilitate retaining the one or more second pin portions within the one or more base slot components when the one or more second pin portions have been inserted in the one or more base slot components. The one or more base slot components also can be formed to respectively comprise one or more open regions that can facilitate accommodating the one or more second pin portions of the pin component when the one or more second pin portions have been inserted in the one or more base slot components, as more fully described herein.

It is to be appreciated and understood that devices or components (e.g., container, container component, hinge component, base component, pin component, base slot component, walls, recessed portion, etc.), as described with regard to a particular component, device, system, or method, can include the same or similar functionality as respective components (e.g., respectively named components) as described with regard to other components, devices, systems, or methods disclosed herein.

In the subject disclosure, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

What has been described above includes examples of systems and methods that provide advantages of the disclosed subject matter. It is, of course, not possible to describe every conceivable combination of components or methodologies for purposes of describing the claimed subject matter, but one of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

What is claimed is:

1. A container, comprising:

a container component comprising a closed end and side walls associated with and extending away from the closed end, wherein the container component comprises an open end located at first ends of the side walls that are opposite from second ends of the side walls that are associated with the closed end;

a lid component configured to at least substantially cover the open end of the container component when the lid component is in a closed position with respect to the container component; and a hinge component comprising a pin component that is associated with one of an edge of the lid component or a side wall of the container component, and comprising a base component that is associated another one of the edge of the lid component or the side wall of the container component, wherein the pin component comprises one or more first pin portions that have a first shape and a first size, and one or more second pin portions that have a second shape and a second size that is larger than the first size, wherein the base component comprises one or more base slot components configured to have respective slot open ends into which the one or more second pin portions are insertable to facilitate attachment of the pin component to the base component and formation of the hinge component, and facilitate retention of the one or more second pin portions within the one or more base slot components, wherein the one or more base slot components comprise a base slot component, wherein the one or more first pin portions comprise a first pin portion, wherein the one or more second pin portions comprise a second pin portion, wherein the respective slot open ends comprise a slot open end, and wherein the base slot component is configured to comprise an open region that is at least partially defined by adjacent side members of the base slot component that are separated from each other by a defined length that is based at least in part on the second size of a second pin portion, wherein the adjacent side members are connected to each other by a connecting member that spans between the adjacent side members to at least partially define the open region and at least partially define the slot open end, wherein the slot open end has a third size that is smaller than the second size of the second pin portion and larger than the first size of the first pin portion, and wherein the second pin portion is insertable into the open region via insertion of the second pin portion into the slot open end based at least in part on a flexibility of the base slot component.

2. The container of claim 1, wherein the pin component is associated with the lid component, and wherein the base component is associated with the container component.

3. The container of claim 1, wherein the first shape is substantially cylindrical and the second shape is substantially cylindrical.

4. The container of claim 1, wherein the open region is configured to accommodate the second pin portion, based at least in part on the second size of the second pin portion, when the second pin portion is inserted into the base slot component.

5. The container of claim 4, wherein the second pin portion is insertable into the slot open end to facilitate snappably attaching the pin component to the base component to form the hinge component, and wherein a first end portion of the first pin portion is adjoined to a second end portion of the second pin portion.

6. The container of claim 1, wherein another end of the base slot component is located opposite to the slot open end with respect to the base slot component, wherein at least a portion of the other end of the base slot component is substantially semi-circular in shape to facilitate accommodation of the first shape of the first pin portion when the second pin portion is located within the open region of the base slot component, and wherein the first shape is substantially cylindrical to correspond to the shape of the other end of the base slot component.

7. The container of claim 1, wherein the flexibility of the base slot component is a sufficient flexibility to enable the slot open end to move to enable the second pin portion to be inserted into the slot open end and the open region of the base slot component, and wherein the base slot component has sufficient rigidity to retain the second pin portion within the base slot component and the open region when the second pin portion has been inserted into the base slot component and the open region.

8. The container of claim 1, wherein the slot open end of the base slot component is flared to facilitate enabling the second pin portion to be inserted into the base slot component.

9. The container of claim 1, wherein the lid component is movable about the hinge component between the closed position and an open position with respect to the container component.

10. The container of claim 1, wherein the side walls of the container component comprise at least a first side wall and a second side wall, wherein at least a portion of the first side wall is substantially semi-circular in shape, wherein at least a portion of the second side wall is substantially flat, and wherein the base component is associated with the second side wall.

11. The container of claim 1, wherein the side walls of the container component comprise at least four side walls, wherein respective portions of the at least four side walls are substantially flat.

12. The container of claim 1, wherein at least one of the container component, the lid component, or the hinge component are formed of at least one of a polymer-based material, a metal material, a fiberglass material, or a wood material.

13. A device, comprising:

a first device component having defined first dimensions that are based at least in part on a use associated with the device;

a second device component having defined second dimensions that at least substantially correspond to a portion of the defined first dimensions, based at least in part on the use associated with the device; and a hinge component comprising a pin component that is associated with one of a first edge of the first device component or a second edge of the second device component, and comprising a base component that is associated another one of the first edge of the first device component or the second edge of the second device component, wherein the pin component comprises one or more first pin portions that have a first shape and a first size, and one or more second pin portions that have a second shape and a second size that is larger than the first size, wherein the base component comprises one or more base slot components configured to have respective slot open ends into which the one or more second pin portions are able to be inserted to facilitate attachment of the pin component to the base component and formation of the hinge component, and facilitate retention of the one or more second pin portions within the one or more base slot components, wherein the second device component is movable about the hinge component between a first position and a second position with respect to the first device component, wherein the one or more base slot components comprise a base slot component, wherein the one or more first pin portions comprise a first pin portion, wherein the one or more second pin portions comprise a second pin portion, and wherein the respective slot open ends comprise a slot open end, and wherein the base slot component is configured to comprise an open region that is at least partially defined by respective side members of the base slot component that are separated from each other by a defined length that is based at least in part on the second size of a second pin portion, wherein the respective side members are connected to each other by a joining member that spans between the respective side members to at least partially define the open region and at least partially define the slot open end, wherein the slot open end has a third size that is smaller than the second size of the second pin portion and larger than the first size of the first pin portion, and wherein the second pin portion is insertable into the open region via the slot open end based at least in part on a flexibility of the base slot component.

14. The device of claim 13, wherein the first shape is substantially cylindrical and the second shape is substantially cylindrical.

15. The device of claim 13, wherein open region is configured to accommodate the second pin portion at least partially within the open region, based at least in part on the second size of the second pin portion, when the second pin portion is inserted into the base slot component.

16. The device of claim 15, wherein the second pin portion is insertable into the slot open end to facilitate snappably attaching the pin component to the base component to form the hinge component, wherein a first end portion of the first pin portion is associated with a second end portion of the second pin portion, and wherein another end of the base slot component is located opposite to the slot open end with respect to the base slot component, wherein at least a portion of the other end of the base slot component is substantially semicircular in shape to facilitate accommodation of the first shape of the first pin portion when the second pin portion is located within the open region of the base slot component, and wherein the first shape is substantially cylindrical to correspond to the shape of the other end of the base slot component.

17. The device of claim 13, wherein the flexibility of the base slot component is a sufficient flexibility to enable the base slot component to move to enable the second pin portion to be inserted into the slot open end and the open region of the base slot component, and wherein the base slot component has sufficient rigidity to retain the second pin portion within the base slot component and the open region when the second pin portion has been inserted into the base slot component and the open region.

18. The device of claim 13, wherein at least one of the first device component, the second device component, or the hinge component are formed of at least one of a polymer-based material, a metal material, a fiberglass material, or a wood material.

19. A method, comprising:

forming a container comprising a closed end and side walls having ends associated with the closed end, wherein the side walls extend outward from the closed end, wherein other ends of the side walls of the container are structured in relation to each other to form an open end of the container and are located opposite to the ends of the side walls that are associated with the closed end;

forming a lid that is sized and shaped to at least substantially cover the open end of the container when the lid is in a closed position with respect to the container; and forming a hinge comprising a pin that is associated with an edge of the lid, and comprising a base that is associated with a side wall of the side walls of the container, wherein the pin comprises one or more first pin portions that have a first substantially cylindrical shape and a first size, and one or more second pin portions that have a second substantially cylindrical shape and a second size that is larger than the first size, wherein the base comprises one or more base slots configured to have respective slot open ends into which the one or more second pin portions are insertable to facilitate attachment of the pin to the base and forming the hinge, and facilitate retaining the one or more second pin portions within the one or more base slots when the one or more second pin portions have been inserted in the one or more base slots, wherein the one or more base slots comprise a base slot, wherein the one or more first pin portions comprise a first pin portion, wherein the one or more second pin portions comprise a second pin portion, and wherein the respective slot open ends comprise a slot open end, and wherein the base slot comprises an open region that is at least partially defined by a first side member and a second side member of the base slot that are a defined distance from each other, wherein the defined distance is based at least in part on the second size of a second pin portion, wherein the first side member and the second side member are connected to each other by a connecting member that spans between the first side member and the second side member to at least partially define the open region and at least partially define the slot open end, wherein the slot open end has a third size that is smaller than the second size of the second pin portion and larger than the first size of the first pin portion, and wherein the second pin portion is insertable into the open region via the slot open end due in part to a flexibility of the base slot.

20. The method of claim 19, further comprising:

forming the base slot to comprise the open region, the slot open end, and another end of the base slot, wherein the open region is configured to accommodate the second pin portion, based at least in part on the second size of the second pin portion, when the second pin portion is inserted into the base slot, wherein the slot open end is structured to have an opening into which the second pin portion is insertable to facilitate attaching the pin to the base to form the hinge, and wherein a first end portion of the first pin portion is adjoined to a second end portion of the second pin portion, and wherein the other end of the base slot is located opposite to the slot open end with respect to the base slot, and wherein at least a portion of the other end of the base slot is substantially semi-circular in shape to correspond to and facilitate accommodation of the first shape of the first pin portion when the second pin portion is located within the open region of the base slot.

* * * * *